US009355587B2

(12) United States Patent
Su et al.

(10) Patent No.: US 9,355,587 B2
(45) Date of Patent: May 31, 2016

(54) METHOD FOR DRIVING DISPLAY USING SUB PIXEL RENDERING

(71) Applicant: AU Optronics Corp., Hsin-Chu (TW)

(72) Inventors: Shang-Yu Su, Hsin-Chu (TW); Sheng-Wen Cheng, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 44 days.

(21) Appl. No.: 14/288,410

(22) Filed: May 28, 2014

(65) Prior Publication Data

US 2015/0235587 A1 Aug. 20, 2015

(30) Foreign Application Priority Data

Feb. 17, 2014 (TW) ..... 103105135 A

(51) Int. Cl.
*G09G 3/20* (2006.01)

(52) U.S. Cl.
CPC ..... *G09G 3/2003* (2013.01); *G09G 2300/0452* (2013.01); *G09G 2320/0242* (2013.01); *G09G 2320/0276* (2013.01); *G09G 2340/0457* (2013.01)

(58) Field of Classification Search
None
See application file for complete search history.

(56) References Cited

U.S. PATENT DOCUMENTS

| | | | | |
|---|---|---|---|---|
| 8,519,910 | B2 | 8/2013 | Park | |
| 2007/0080975 | A1* | 4/2007 | Yamashita | G09G 5/04 345/591 |
| 2011/0037774 | A1* | 2/2011 | Chen | G09G 3/006 345/589 |
| 2011/0057950 | A1* | 3/2011 | Kim | G09G 5/02 345/602 |
| 2011/0242149 | A1* | 10/2011 | Yoshida | G09G 3/3648 345/690 |
| 2013/0194494 | A1 | 8/2013 | Chun | |
| 2014/0093159 | A1* | 4/2014 | Nguyen | G06T 5/002 382/154 |
| 2014/0232735 | A1* | 8/2014 | Jeong | G09G 3/2059 345/589 |

* cited by examiner

*Primary Examiner* — William Boddie
*Assistant Examiner* — Bipin Gyawali
(74) *Attorney, Agent, or Firm* — Winston Hsu; Scott Margo

(57) ABSTRACT

A driving method for rendering subpixels of each pixel of a display is provided. The display has a plurality of first pixels and a plurality of second pixels. Each second pixel has a first color subpixel and a second color subpixel, but lacks a third color subpixel. Each first pixel has a second color subpixel and a third color subpixel, but lacks a first color subpixel. The first color subpixel, second color subpixel and third color subpixel are used to represent gray levels of a first color, a second color and a third color respectively. Processes of rendering the subpixels of each pixel are performed based on positions, saturations and brightness of neighboring pixels, such that quality of image displayed on the display could be ensured even though each first pixel lacks the first color subpixel and each second pixel lacks the third color subpixel.

7 Claims, 8 Drawing Sheets

METHOD FOR DRIVING DISPLAY USING SUB PIXEL RENDERING

BACKGROUND OF THE INVENTION

1. Field of the Invention

The invention is related to a method for driving a display, and more particularly, to a method for driving an SPR display.

2. Description of the Prior Art

As the requirements for visual effects on consuming electronic devices become higher, resolution of display devices are also increased to output high quality images. Please refer to FIG. 1. FIG. 1 shows part of the pixels on the display 100 according to a prior art. The display 100 adopts a traditional way of pixel arrangement. The display 100 comprises a plurality of pixels 110, and each of the pixels 110 comprises a red color subpixel 120R, a green color subpixel 120G, and a blue color subpixel 120B. However, while the resolution of the display is increased, the visibility rate of the red color subpixel 120R, the visibility rate of the green color subpixel 120G, and the visibility rate of the blue color subpixel 120B are decreased as well. Consequently, even under the same condition of backlight strength, displays with higher resolution will seem darker than displays with lower resolution.

To solve the issue of low brightness, Sub Pixel Rendering (SPR) is thus proposed to drive the displays. The SPR display enlarges the area of the subpixel so as to increase the visibility rate of the subpixel. Please refer to FIG. 2. FIG. 2 shows the driving method for an SPR display according to a prior art. The display 200 is an SPR display. The display 200 comprises a plurality of pixels 210 and a plurality of pixels 220, where the pixels 210 and the pixels 220 are disposed in an interleaved manner. Each of the pixels 210 comprises a red color subpixel 230R and a green color subpixel 230G. Each of the pixels 220 comprises a blue color subpixel 230B and a green color subpixel 230G. The area of the red color subpixel 230R is larger than the area of the green color subpixel 230G, and the area of the blue color subpixel 230B is also larger than the area of the green color subpixel 230G. However, since the pixel 210 lacks the blue color subpixel 230B and the pixel 220 lacks the red color subpixel 230R, the display 200 will render colors to the subpixels of each of pixels 210 and pixels 220.

When the display 200 is rendering the colors to the subpixels, the blue rendering value $B_D$ of each of the pixels 210 will be dispatched to the blue color subpixels of the pixels 220 adjacent to the pixel 210 randomly and the red rendering value $R_D$ of each of the pixels 220 will be dispatched to the red color subpixels of the pixels 210 adjacent to the pixel 220 randomly. However, because the brightness and saturation of the pixels 210 and 220 to be rendered are not in the consideration of the method above, edges of words in the image displayed on the display 200 may seem blurred. That is, the issue of blurring edge of words shows up because of the improper diffusion of colors.

SUMMARY OF THE INVENTION

One embodiment of present invention discloses a method for driving a display. The method for driving a display comprises transforming a first gray level value, a second gray level value, and a third gray level value of a first pixel into a first gamma value, a second gamma value, and a third gamma value of the first pixel respectively, transforming a first gray level value, a second gray level value, and a third gray level value of a plurality of second pixels into a first gamma value, a second gamma value, and a third gamma value of the plurality of second pixels respectively, wherein the plurality of second pixels are adjacent to the first pixel, deriving saturation and brightness of each of the plurality of second pixels, setting a priority order of each of the plurality of second pixels according to the saturation of each of the second pixels, the brightness of each of the second pixels, and a distance between a first color subpixel of each of the plurality of second pixels and a second color subpixel of the first pixel, dispatching the first gamma value of the first pixel to the plurality of second pixels to change the first gamma value of at least one of the plurality of second pixels according to the priority orders of the plurality of second pixels, updating the third gamma value of the first pixel according to a first rendering value of each of the plurality of second pixels, wherein the first rendering value of each of the plurality of second pixels is related to the third gamma value of each of the plurality of second pixels, driving the second color subpixel of the first pixel and a third color subpixel of the first pixel according to the second gamma value of the first pixel and the third gamma value of the first pixel after updating the third gamma value of the first pixel; and driving the first color subpixel of each of the plurality of second pixels and a second color subpixel of each of the plurality of second pixels according to the first gamma value of each of the plurality of second pixels and the second gamma value of the plurality of second pixels after dispatching the first gamma value of the first pixel to the plurality of second pixels.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
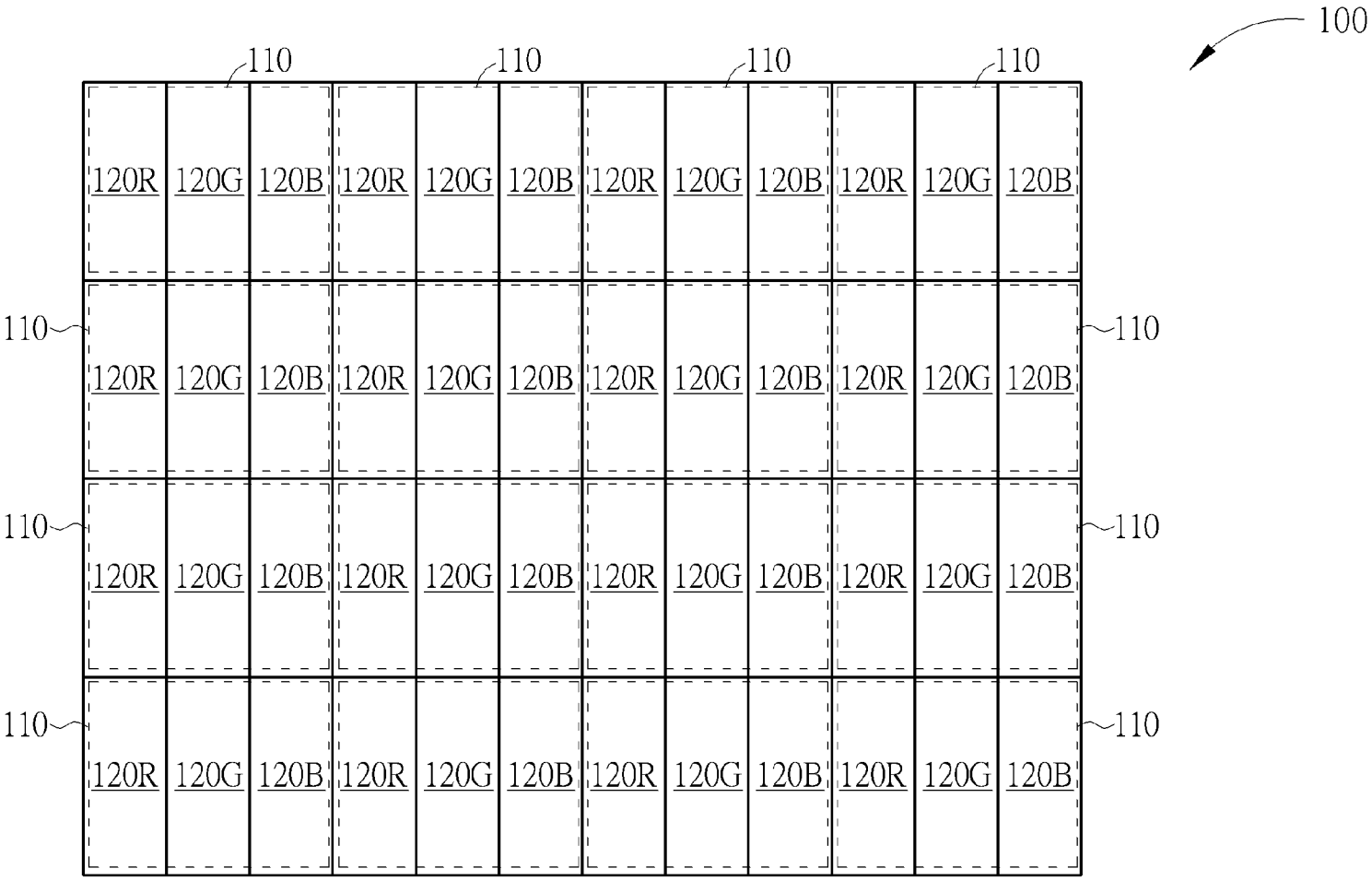
FIG. 1 PRIOR ART
FIG. 1 shows part of the pixels of the display according to the prior art.
Figure 2:
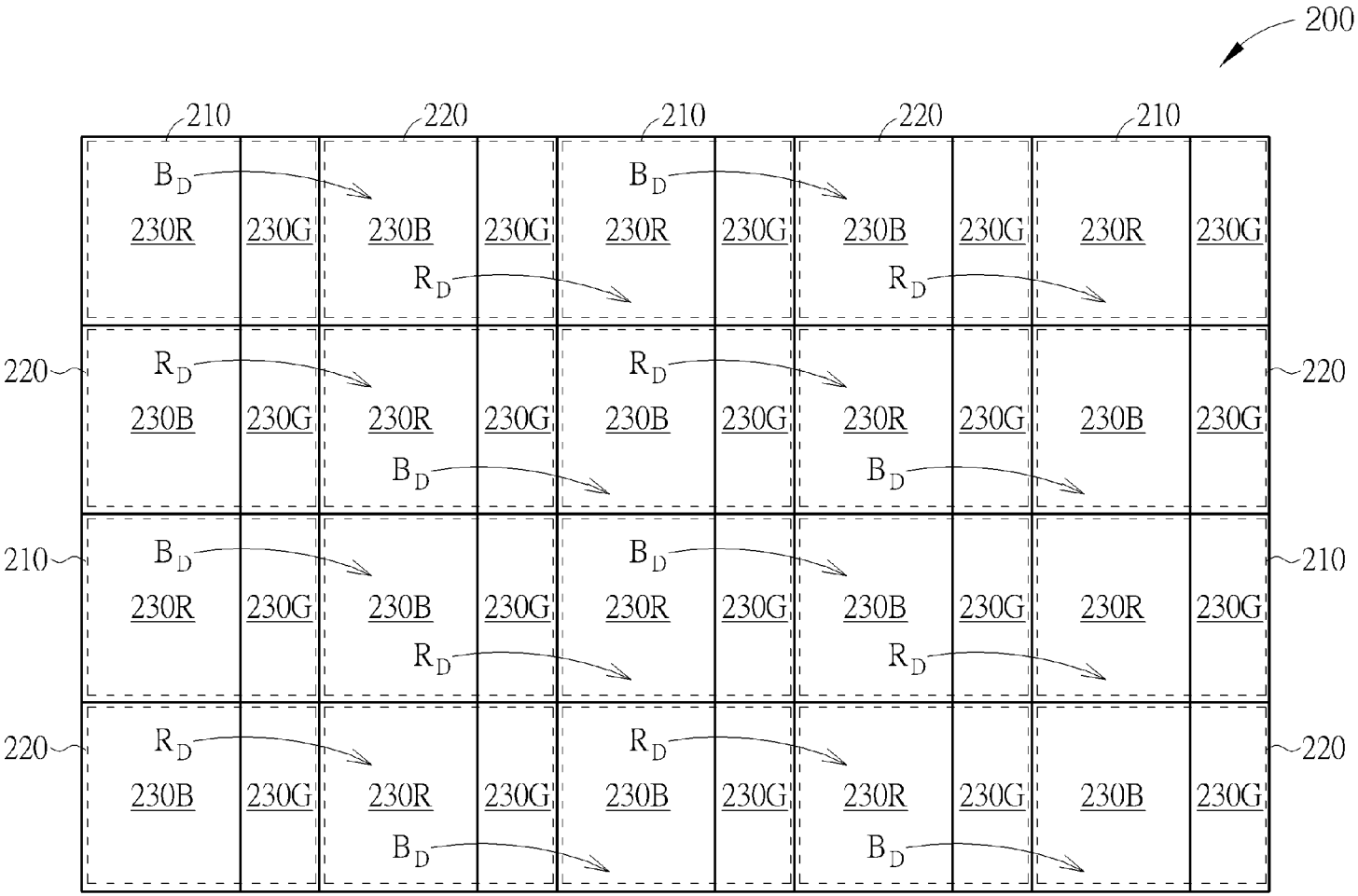
FIG. 2 PRIOR ART
FIG. 2 shows how the SPR display is driven according to the prior art.
Figure 3:
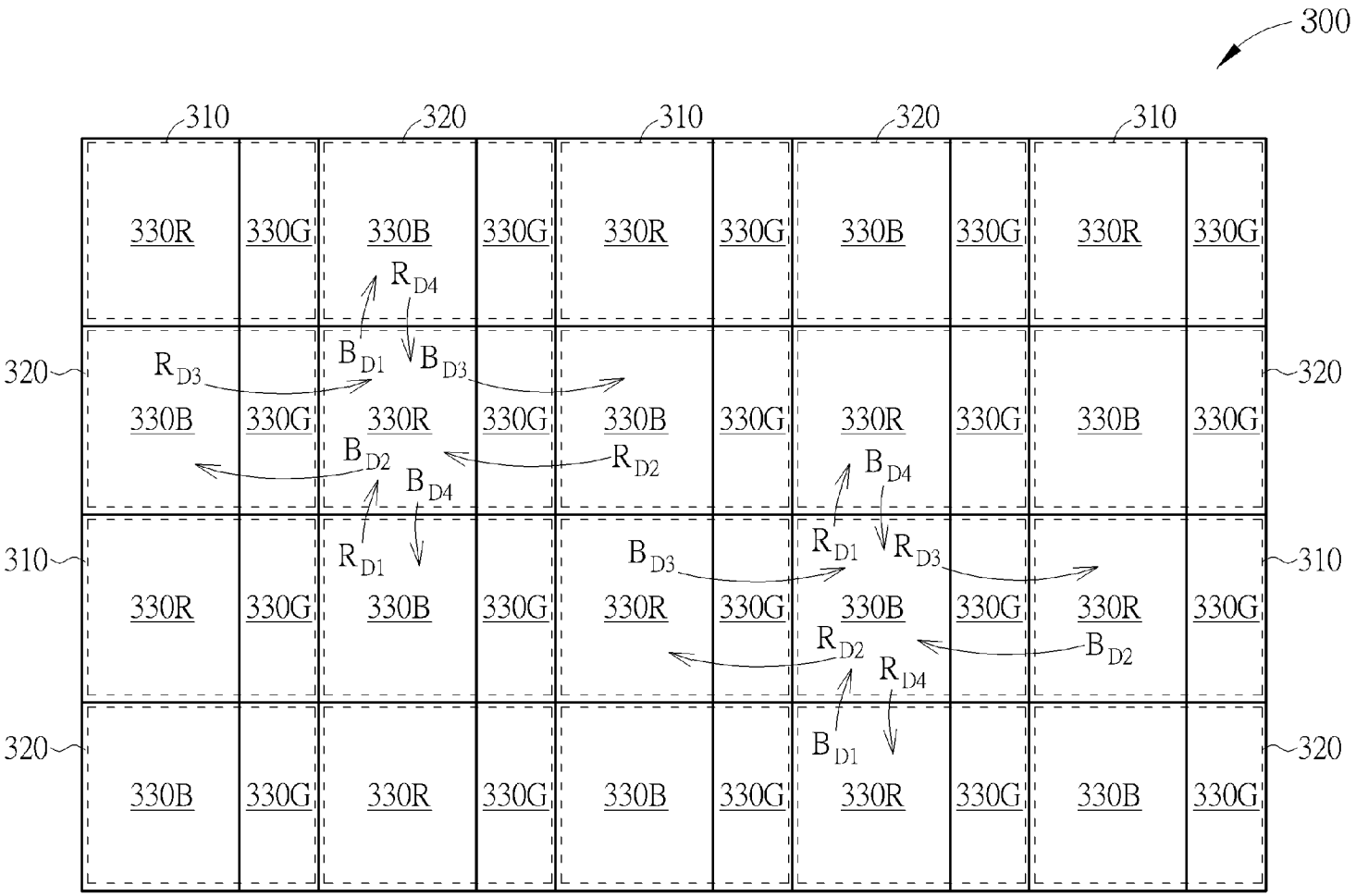
FIG. 3 shows how the SPR display is driven according to one embodiment of the present invention.

Please refer to FIG. 3. FIG. 3 shows a method for driving a display according to one embodiment of the present invention. The display 300 is an SPR display and comprises of a plurality of pixels 310 and a plurality of pixels 320, where the pixels 310 and the pixels 320 are disposed in an interleaved manner. Each of the pixels 310 comprises a red color subpixel 330R and a green color subpixel 330G. Each of the pixels 320 comprises a blue color subpixel 330B and a green color subpixel 330G. The area of the red color subpixel 330R is larger than the area of the green color subpixel 330G, and the area of the blue color subpixel 330B is also larger than the area of the green color subpixel 330G. In one embodiment of the present invention, the area of the red color subpixel 330R is two times the area of the green color subpixel 330G and the area of the blue color subpixel 330B is two times the area of the green color subpixel 330G. However, the present invention is not limited to the aforesaid embodiment. Since the pixel 310 lacks blue color subpixel 330B and pixel 320 lacks the red color subpixel 330R, the display 300 will render the colors to the subpixels of each of the pixels 310 and 320.

When the display 300 is rendering colors to the subpixels, the blue rendering values $B_{D1}$, $B_{D2}$, $B_{D3}$, and $B_{D4}$ of the pixel 310 will be dispatched to the blue color subpixels 330B of the pixels 320, where the pixels 320 are disposed above of, on the left of, on the right of, and beneath of the pixel 310, since the pixel 310 cannot display the blue color. Notice that the descriptions of location such as "above", "on the left", "on the right", and "beneath" as mentioned above are used to describe the related locations of the pixels 310 and 320 and are not used to limit the present invention. Similarly, the red rendering values $R_{D1}$, $R_{D2}$, $R_{D3}$, and $R_{D4}$ of the pixel 320 will be dispatched to the red color subpixels 330R of the pixels 310, where the pixels 310 are disposed above of, on the left of, on the right of, and beneath of the pixel 320, since the pixel 320 cannot display the red color. Where any of the red rendering values $R_{D1}$, $R_{D2}$, $R_{D3}$, and $R_{D4}$ and any of the blue rendering values $B_{D1}$, $B_{D2}$, $B_{D3}$, and $B_{D4}$ can be zero. In addition, if the rendering value is zero, the corresponding subpixel will not be rendered. The detail about how to derive the blue rendering values $B_{D1}$, $B_{D2}$, $B_{D3}$, and $B_{D4}$ of the pixel 310 and the red rendering values $R_{D1}$, $R_{D2}$, $R_{D3}$, and $R_{D4}$ of the pixel 320 will be explained later. Furthermore, the red color subpixel 330R of the pixel 310 will accept the red rendering values $R_{D1}$, $R_{D2}$, $R_{D3}$, and $R_{D4}$ from the four neighboring pixels 320 disposed above of, on the left of, on the right of, and beneath of the pixel 310 respectively, and the blue color subpixel 330B of the pixel 320 will accept the blue rendering values $B_{D1}$, $B_{D2}$, $B_{D3}$, and $B_{D4}$ from the four neighboring pixels 310 disposed above of, on the left of, on the right of, and beneath of the pixel 320 respectively. To be understood, if the pixel 310 or 320 is disposed at the upper right, the upper left, the lower right, or the lower left corner of the display 300, then the pixel 310 or 320 at the corner will only dispatch two rendering values and will only accept other two rendering values at most. For example, the pixel 310 disposed at the upper left corner of the display 300 can only possibly dispatch the blue rendering value $B_{D3}$ and $B_{D4}$, and accept the red rendering value $R_{D2}$ and $R_{D1}$ from the two pixels 320 disposed on the right and beneath of the pixel 310. In addition, if the pixel 310 or 320 is not disposed on the corner of the display 300 but disposed on an edge of the display 300, then the pixel 310 or 320 disposed on the edge of display 300 will only dispatch three rendering values and accept three other rendering values at most. For example, the pixel 320 disposed at the second row and first column of the display 300 can only possibly dispatch the red rendering value $R_{D1}$, $R_{D3}$, and $R_{D4}$, and accept the blue rendering value $B_{D4}$, $B_{D2}$, and $R_{D1}$ from the three pixels 310 disposed above of, on the right of and beneath of the pixel 320. Furthermore, to be understood, in FIG. 3, the pixel at the first row and the first column of the display 300 is a pixel 310, but the present invention is not limited to this arrangement. In other embodiments of the present invention, the pixel at the first row and the first column of the display 300 can be a pixel 320. Also, for the convenience of explanation, FIG. 3 only shows four rows and five columns of pixels in display 300, which is not to limit the present invention. This invention can also be adopted by other display with more rows or columns.

Figure 4:
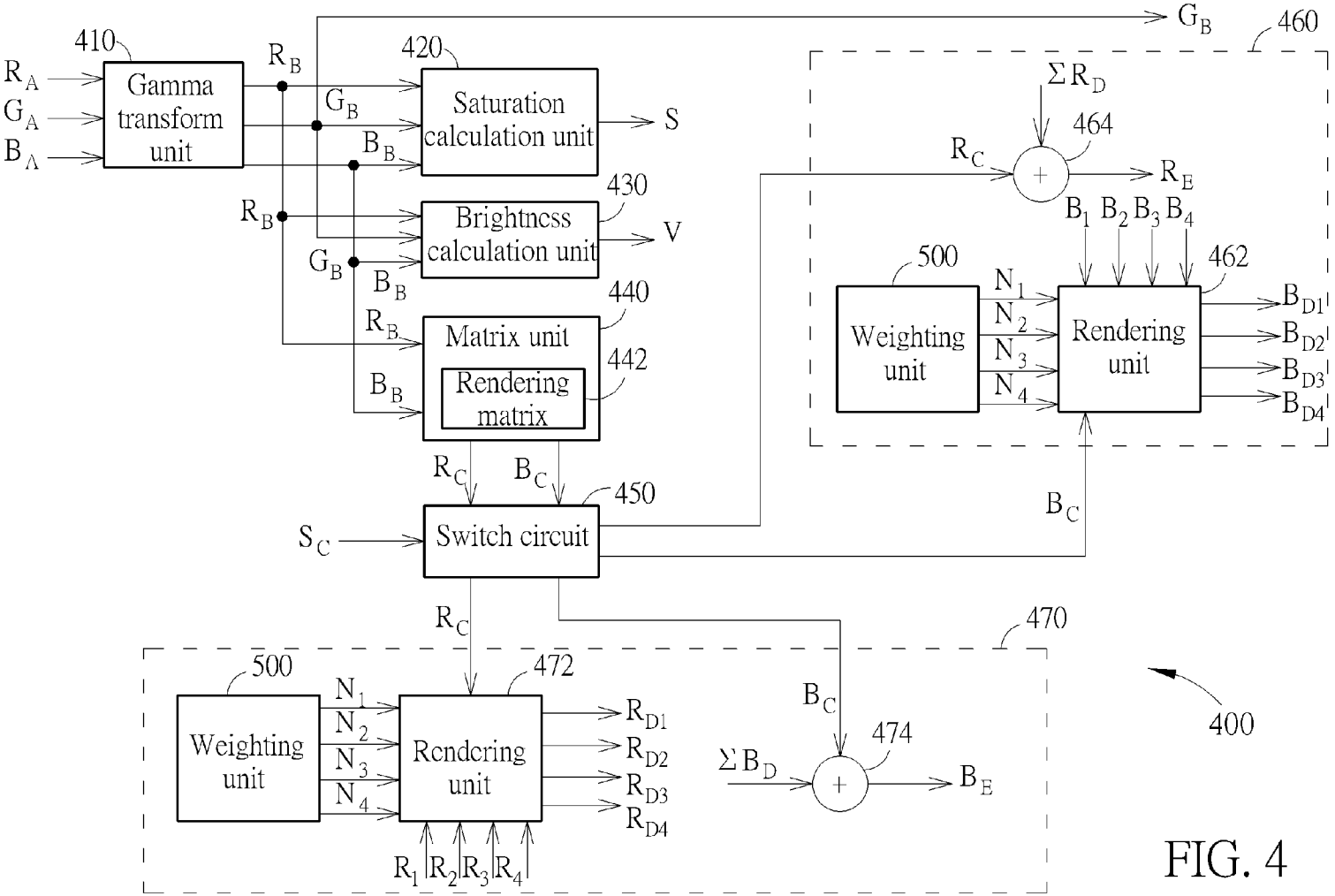
FIG. 4 shows a driver according to one embodiment of the present invention.

Please refer to FIG. 4 and FIG. 3. FIG. 4 shows a driver 400 according to one embodiment of the present invention. The driver 400 is used to drive the pixels 310 and 320 of the display 300. The driver 400 will calculate the rendering value of each of the pixels 310 that are to be dispatched to the pixels 320 adjacent to the pixel 310 (ex., at least two of the rendering values among $B_{D1}$, $B_{D2}$, $B_{D3}$, and $B_{D4}$), and calculate the rendering value of each of the pixels 320 that are to be dispatched to the pixels 310 adjacent to the pixel 320 (ex., at least two of the rendering values among $R_{D1}$, $R_{D2}$, $R_{D3}$, and $R_{D4}$). In one embodiment of the present invention, driver 400 calculates the pixel 310 at the first row and first column of the display 300 firstly and calculates the rest of rendering values of each of the pixels 310 and 320 with a manner of left-to-right and up-to-down. After the driver 400 completes the calculation of the rendering values $B_{D3}$ and $B_{D4}$ of the pixel 310 at the first row and first column of the display 300, the driver 400 will start to calculate the rendering values $R_{D2}$, $R_{D3}$ and $R_{D4}$ of the pixel 320 at the first row and second column of the display 300. After the driver 400 completes the calculation of the rendering values of each of the pixels 310 and 320 at the first row of the display 300, driver 400 will start to calculate the rendering values of the pixels 310 and 320 at the second row of the display 300. However, the order of the rendering value calculation of the pixels 310 and 320 is not limited to the manner of left-to-right and up-to-down mentioned above in the present invention. For example, the driver 400 can also calculate the rendering values of the pixels 310 and 320 from right to left and from down to up. In addition, since the output image of the display 300 will be updated, the driver 400 will recalculate the rendering values of the pixels 310 and 320 to drive the pixels 310 and 320 during each frame period.

The driver 400 comprises a gamma transform unit 410, a saturation calculation unit 420, and a brightness calculation unit 430. The gamma transform unit 410 is used to receive the gray level values $R_A$, $G_A$, and $B_A$ of each of the pixels 310 and 320 and to transform the gray level values $R_A$, $G_A$, and $B_A$ of each of the pixels 310 and 320 into the gamma values $R_B$, $G_B$, and $B_B$ of each of the pixels 310 and 320, where the gray level values $R_A$, $G_A$, and $B_A$ are corresponding to red, green and blue colors respectively. The saturation calculation unit 420 can calculate the saturation S of each of the pixels 310 and 320 according to the gamma values $R_B$, $G_B$, and $B_B$ of each of the pixels 310 and 320. The brightness calculation unit 430 can calculate the brightness V of each of the pixels 310 and 320 according to the gamma values $R_B$, $G_B$, and $B_B$ of each of the pixels 310 and 320. In one embodiment of this invention, the saturation S, the brightness V, and the gamma values $R_B$, $G_B$, and $B_B$ of each of the pixels 310 and 320 can be derived by formula (1) to (5):

$$R_B=(R_A/255)^{2.2} \quad \text{Formula (1):}$$

$$G_B=(G_A/255)^{2.2} \quad \text{Formula (2):}$$

$$B_B=(B_A/255)^{2.2} \quad \text{Formula (3):}$$

$$S=[\max(R_B,G_B,B_B)-\min(R_B,G_B,B_B)]/\max(R_B,G_B,B_B) \quad \text{Formula (4):}$$

$$V=\max(R_B,G_B,B_B) \quad \text{Formula (5):}$$

In formula (4) and (5), max ($R_B$, $G_B$, $B_B$) represents the biggest gamma value among the gamma values $R_B$, $G_B$, $B_B$ and min ($R_B$, $G_B$, $B_B$) represents the smallest gamma value among the gamma values $R_B$, $G_B$, $B_B$.

In addition, the driver 400 also comprises a matrix unit 440 for processing the matrix calculation on the gamma values $R_B$ and $B_B$ according to the rendering matrix 442 and outputting the gamma values $R_C$ and $B_C$. Since the gamma values $R_B$ and $B_B$ are transformed into the gamma values $R_C$ and $B_C$ by the matrix unit 440, the gamma values $R_B$ and $B_B$ are also called "initial gamma value". In one embodiment of the present invention, rendering matrix 442 can be represented as $$\begin{bmatrix} M_R & 0 \\ 0 & M_B \end{bmatrix},$$

and the gamma values $R_C$ and $B_C$ can be derived by formula (6):

$$[R_C \quad B_C] = [R_B \quad B_B]\begin{bmatrix} M_R & 0 \\ 0 & M_B \end{bmatrix} \qquad \text{Formula (6)}$$

Thus, $$R_C = R_B \times M_R \qquad \text{Formula (7):}$$

$$B_C = B_B \times M_B \qquad \text{Formula (8):}$$

In one embodiment of the present invention, the element $M_R$ of rendering matrix 442 can be equal to the area ratio of the green color subpixel 330G to the red color subpixel 330R, and the element $M_B$ of rendering matrix 442 can be set equal to the area ratio of the green color subpixel 330G to the blue color subpixel 330B. Therefore, if the area of the red color subpixel 330R is two times larger than the area of the green color subpixel 330G, and the area of the blue color subpixel 330B is also two times larger than the area of the green color subpixel 330G, then both the elements $M_R$ and $M_B$ will equal 0.5.

Furthermore, since the rendering method for pixels 310 and the rendering method for pixels 320 are different, the driver 400 will render the pixels 310 and 320 by rendering modules 460 and 470 respectively. To be more specific, the driver 400 further contains a switch circuit 450 and the driver 400 will generate a switch control signal $S_C$ by judging whether the gamma values $R_C$ and $B_C$ belong to pixel 310 or 320. After the switch control signal $S_C$ is generated, the switch circuit 450 can pass the gamma values $R_C$ and $B_C$ to the rendering module 460 or 470 for further processing according to the switch control signal $S_C$. If the pixel data processed by the driver 400 belongs to pixels 310, namely, the gamma values $R_C$ and $B_C$ belong to pixels 310, then the switch circuit 450 will pass the gamma values $R_C$ and $B_C$ to the rendering module 460 for further processing. Similarly, if the pixel data processed by the driver 400 belongs to pixels 320, namely, the gamma values $R_C$ and $B_C$ belong to pixels 320, then the switch circuit 450 will pass the gamma values $R_C$ and $B_C$ to the rendering module 470 for further processing.

The rendering module 460 includes a rendering unit 462, an adder 464 and a weighting unit 500. Where the weighting unit 500 is used to generate the weighting products $N_1$, $N_2$, $N_3$ and $N_4$ of the four pixels 320 according to the displaying information of the four pixels 320 and the related positions of the blue color subpixel 330B of the four pixels 320 to the green color subpixel 330G of the pixel 310. The four pixels 320 are disposed above of, on the left of, on the right of, and beneath of the pixel 310 respectively. The weighting product $N_1$ corresponds to the pixel 320 disposed above of the pixel 310, the weighting product $N_2$ corresponds to the pixel 320 disposed on the left of the pixel 310, the weighting product $N_3$ corresponds to the pixel 320 disposed on the right of the pixel 310, and the weighting product $N_4$ corresponds to the pixel 320 disposed beneath of the pixel 310. Notice that, if the pixel 310 is disposed at the upper right, the upper left, the lower right, or the lower left corner of the display 300, then the weighting unit 500 will only generate two weighting products for this kind of pixel 310. For example, for the pixel 310 at the upper left corner of the display 300, the weighting unit 500 will only generate the weighting products $N_3$ and $N_4$ coming from the pixel 320 disposed on the right of the pixel 310 and the pixel 320 disposed beneath of the pixel 310 respectively. In addition, if the pixel 310 is disposed on the edges of the display 300 instead of at the corner of display 300, then the weighting unit 500 will only generate three weighting products for this kind of pixel 310. For example, for the pixel 310 disposed at the $3^{rd}$ row and the $1^{st}$ column, the weighting unit 500 will only generate the weighting products $N_1$, $N_3$ and $N_4$ coming from the pixel 320 disposed above of the pixel 310, the pixel 320 disposed on the right of the pixel 310 and the pixel 320 disposed beneath of the pixel 310 respectively. Below will further explain how the weighting unit 500 can generate the weighting products $N_1$, $N_2$, $N_3$ and $N_4$.

The rendering unit 462 will divide the gamma value $B_C$ into different rendering values of $B_{D1}$, $B_{D2}$, $B_{D3}$ and $B_{D4}$ according to the gamma value $B_1$, $B_2$, $B_3$ and $B_4$ of the pixels 320 disposed above of, on the left of, on the right of, and beneath of the pixel 310 and the weighting products $N_1$, $N_2$, $N_3$ and $N_4$ aforesaid. Namely, $$B_C = B_{D1} + B_{D2} + B_{D3} + B_{D4} \qquad \text{Formula (9):}$$

Where the rendering values of $B_{D1}$, $B_{D2}$, $B_{D3}$ and $B_{D4}$ will be dispatched to the pixels 320 disposed above of, on the left of, on the right of, and beneath of the pixel 310 respectively. Furthermore, the rendering unit 462 will set up the priority orders of the upper, left, right and the lower pixels 320 according to the weighting products $N_1$, $N_2$, $N_3$ and $N_4$. The pixel 320 with a larger weighting product has the higher priority order. For example, if $N_3 > N_1 > N_4 > N_2$, then the priority orders of the four pixels 320 will be the right pixel 320, the upper pixel 320, the lower pixel 320 and then the left pixel 320, from the first to the last. Consequently, the gamma value $B_C$ will be dispatched to the right pixel 320 firstly. In addition, to avoid the excess of the gamma values of the blue color subpixels 330B of the upper, left, right and lower pixels 320 after dispatching the gamma value $B_C$, the display 300 will set a threshold value on the rendering unit 462 and keep the gamma value of the blue color subpixel of the rendered pixel 320 within the threshold value. Assuming $G_{TH}$ represents the threshold value, $G_{TH}$ can be set to 1. Furthermore, with the same priority orders of the pixels 320 as the aforesaid example, the rendering value $B_{D3}$ will be equal to the gamma value $B_C$ if the sum of the gamma value $B_3$ and $B_C$ is smaller than or equal to the threshold value $G_{TH}$. However, if the sum of the gamma value $B_3$ and $B_C$ is larger than the threshold value $G_{TH}$, then the rendering value $B_{D3}$ will be equal to the threshold value $G_{TH}$ subtracting the gamma value $B_3$ as below:

$$\begin{cases} B_{D3} = B_C & \text{, if } B_C + B_3 \le G_{TH} \\ B_{D3} = G_{TH} - B_3 & \text{, if } B_C + B_3 > G_{TH} \end{cases} \qquad \text{Formula (10)}$$

In addition, after the rendering value $B_{D3}$ is confirmed, if the sum of the gamma value $B_C$ and $B_3$ is larger than the threshold value $G_{TH}$, the rendering unit 462 will calculate the remaining gamma value ($B_C+B_3-G_{TH}$) and dispatch the remaining gamma value ($B_C+B_3-G_{TH}$) to the rest of the upper, the lower, and the left pixels 320 according to the aforesaid priority orders except for the right pixel 320, which has the highest priority order. Namely, when $B_C+B_3>G_{TH}$, the remaining gamma value ($B_C+B_3-G_{TH}$) will be dispatched to the upper pixel 320 at the first place because the upper pixel 320 has the priority order of the second place. The rendering value $B_{D1}$ of the upper pixel 320 can be described as:

$$\begin{cases} B_{D1} = B_C + B_3 - G_{TH} & \text{, if } B_C + B_3 + B_1 \le 2G_{TH} \\ B_{D1} = G_{TH} - B_1 & \text{, if } B_C + B_3 + B_1 > 2G_{TH} \end{cases} \quad \text{Formula (11)}$$

After the rendering value $B_{D1}$ is confirmed, if the sum of the gamma value $B_C$, $B_3$ and $B_1$ is larger than two times the threshold value $G_{TH}$, the rendering unit 462 will calculate the remaining gamma value ($B_C+B_3+B_1-2G_{TH}$) and dispatch the remaining gamma value ($B_C+B_3+B_1-2G_{TH}$) to the rest of the lower, and the left pixels 320 according to the aforesaid priority orders. Namely, when $B_C+B_3+B_1>2G_{TH}$, the remaining gamma value ($B_C+B_3+B_1-2G_{TH}$) will be dispatched to the lower pixel 320 at the first place, since the lower pixel 320 has the priority order of the third place. The rendering value $B_{D4}$ of the lower pixel 320 can be described as:

$$\begin{cases} B_{D4} = B_C + B_3 + B_1 - 2G_{TH} & \text{, if } \begin{matrix} B_C + B_3 + B_1 + \\ B_4 \le 3G_{TH} \end{matrix} \\ B_{D4} = G_{TH} - B_4 & \text{, if } \begin{matrix} B_C + B_3 + B_1 + \\ B_4 > 3G_{TH} \end{matrix} \end{cases} \quad \text{Formula (12)}$$

After the rendering value $B_{D4}$ is confirmed, if the sum of the gamma value $B_C$, $B_3$, $B_1$ and $B_4$ is larger than three times the threshold value $G_{TH}$, the rendering unit 462 will calculate the remaining gamma value ($B_C+B_3+B_1+B_4-3G_{TH}$) and dispatch the remaining gamma value ($B_C+B_3+B_1+B_4-3G_{TH}$) to the left pixels 320 since the left pixel 320 has the priority order of the fourth place. However, if the sum of the remaining gamma value ($B_C+B_3+B_1+B_4-3G_{TH}$) and the gamma value $B_2$ is larger than the threshold value $G_{TH}$, then the rendering unit 462 will have the rendering value $B_{D2}$ equal to ($G_{TH}-B_2$), that is, the rendering value $B_{D2}$ of the left pixel 320 can be described as:

$$\begin{cases} B_{D2} = B_C + B_3 + B_1 + B_4 - 3G_{TH} & \text{, if } \begin{matrix} B_C + B_3 + B_1 + \\ B_4 + B_2 \le 4G_{TH} \end{matrix} \\ B_{D2} = G_{TH} - B_2 & \text{, if } \begin{matrix} B_C + B_3 + B_1 + \\ B_4 + B_2 > 4G_{TH} \end{matrix} \end{cases} \quad \text{Formula (13)}$$

The previous explanation is based on the example with priority orders of the pixels 320 as the right pixel 320, the upper pixel 320, the lower pixel 320 and then the left pixel 320, from the first to the last. However, even if the priority orders of the pixels 320 are different, the rendering unit 462 will also generate the rendering value $B_{D1}$, $B_{D2}$, $B_{D3}$ and $B_{D4}$ in a similar way. For example, if the priority orders of the pixels 320 are: the upper pixel 320, the left pixel 320, the right pixel 320 and then the lower pixel 320, namely $N_1>N_2>N_3>N_4$, then the rendering values $B_{D1}$, $B_{D2}$, $B_{D3}$ and $B_{D4}$ can be derived according to the following formulas (14)~(17).

$$\begin{cases} B_{D1} = B_C & \text{, if } B_C + B_1 \le G_{TH} \\ B_{D1} = G_{TH} - B_1 & \text{, if } B_C + B_1 > G_{TH} \end{cases} \quad \text{Formula (14)}$$

-continued $$\begin{cases} B_{D2} = B_C + B_1 - G_{TH} & \text{, if } B_C + B_1 + B_2 \le 2G_{TH} \\ B_{D2} = G_{TH} - B_2 & \text{, if } B_C + B_1 + B_2 > 2G_{TH} \end{cases} \quad \text{Formula (15)}$$

$$\begin{cases} B_{D3} = B_C + B_1 + B_2 - 2G_{TH} & \text{, if } \begin{matrix} B_C + B_1 + B_2 + \\ B_3 \le 3G_{TH} \end{matrix} \\ B_{D3} = G_{TH} - B_3 & \text{, if } \begin{matrix} B_C + B_1 + B_2 + \\ B_3 > 3G_{TH} \end{matrix} \end{cases} \quad \text{Formula (16)}$$

$$\begin{cases} B_{D4} = B_C + B_1 + B_2 + B_3 - 3G_{TH} & \text{, if } \begin{matrix} B_C + B_1 + B_2 + \\ B_3 + B_4 \le 4G_{TH} \end{matrix} \\ B_{D4} = G_{TH} - B_4 & \text{, if } \begin{matrix} B_C + B_1 + B_2 + \\ B_3 + B_4 > 4G_{TH} \end{matrix} \end{cases} \quad \text{Formula (17)}$$

Also, for example, if the priority orders of the pixels 320 are: the upper pixel 320, the right pixel 320, the lower pixel 320 and then the left pixel 320, namely $N_1>N_3>N_4>N_2$, then the rendering values $B_{D1}$, $B_{D3}$, $B_{D4}$ and $B_{D2}$ can be derived according to the following formulas (18)~(21).

$$\begin{cases} B_{D1} = B_C & \text{, if } B_C + B_1 \le G_{TH} \\ B_{D1} = G_{TH} - B_1 & \text{, if } B_C + B_1 > G_{TH} \end{cases} \quad \text{Formula (18)}$$

$$\begin{cases} B_{D3} = B_C + B_1 - G_{TH} & \text{, if } B_C + B_1 + B_3 \le 2G_{TH} \\ B_{D3} = G_{TH} - B_3 & \text{, if } B_C + B_1 + B_3 > 2G_{TH} \end{cases} \quad \text{Formula (19)}$$

$$\begin{cases} B_{D4} = B_C + B_1 + B_3 - 2G_{TH} & \text{, if } \begin{matrix} B_C + B_1 + B_3 + \\ B_4 \le 3G_{TH} \end{matrix} \\ B_{D4} = G_{TH} - B_4 & \text{, if } \begin{matrix} B_C + B_1 + B_3 + \\ B_4 > 3G_{TH} \end{matrix} \end{cases} \quad \text{Formula (20)}$$

$$\begin{cases} B_{D2} = B_C + B_1 + B_3 + B_4 - 3G_{TH} & \text{, if } \begin{matrix} B_C + B_1 + B_3 + \\ B_4 + B_2 \le 4G_{TH} \end{matrix} \\ B_{D2} = G_{TH} - B_2 & \text{, if } \begin{matrix} B_C + B_1 + B_3 + \\ B_4 + B_2 > 4G_{TH} \end{matrix} \end{cases} \quad \text{Formula (21)}$$

Furthermore, the adder 464 of the rendering unit 460 will add the gamma value $R_C$ of the pixel 310 to the sum of the red rendering values $R_{D1}$, $R_{D2}$, $R_{D3}$ and $R_{D4}$ from the four neighboring pixels 320, namely $\Sigma R_D$, so that the rendering unit 460 can output the gamma value $R_E$. In other words, the adder 464 will update the gamma value $R_C$ of the red color subpixel 330R of the pixel 310 according to the rendering value $R_{D1}$, $R_{D2}$, $R_{D3}$ and $R_{D4}$. The updated gamma value $R_C$ of the red color subpixel 330R of the pixel 310 is the gamma value $R_E$. Afterward, the driver 400 will drive the red color subpixel 330R and the green color subpixel 330G by the gamma values $R_E$ and $G_B$ respectively.

Contrarily, if the pixel data processed by the driver 400 belongs to pixel 320, the switch circuit 450 will pass the gamma values $R_C$ and $B_C$ to the rendering module 470 for further processing. The rendering module 470 includes a rendering unit 472, an adder 474 and a weighting unit 500. In the present embodiment, the weighting unit 500 of the rendering unit 470 and the weighting unit 500 of the rendering unit 460 are two different weighting units. However, in other embodiments, the weighting unit 500 of the rendering unit 470 can be the same weighting unit of the rendering unit 460. The weighting unit 500 of the rendering module 470 is used to generate the weighting products $N_1$, $N_2$, $N_3$ and $N_4$ of the four pixels 310 according to the displaying information of the four pixels 310 and the related positions of the red color subpixel 330R of the four pixels 310 to the green color subpixel 330G of the pixel 320. The four pixels 310 are disposed above of, on the left of, on the right of, and beneath of the pixel 320 respectively. The weighting product $N_1$ corresponds to the pixel 310 disposed above of the pixel 320, the weighting product $N_2$ corresponds to the pixel 310 disposed on the left of the pixel 320, the weighting product $N_3$ corresponds to the pixel 310 disposed on the right of the pixel 320, and the weighting product $N_4$ corresponds to the pixel 310 disposed beneath of the pixel 320. Notice that, if the pixel 320 is disposed at the upper right, the upper left, the lower right, or the lower left corner of the display 300, then the weighting unit 500 will only generate two weighting products for this kind of pixel 320. For example, for the pixel 320 at the lower right corner of the display 300, the weighting unit 500 will only generate the weighting products $N_1$ and $N_2$ from the pixel 310 disposed on above the pixel 320 and the pixel 310 disposed on left of the pixel 320 respectively. In addition, if the pixel 320 is disposed on the edges of the display 300 instead of at the corner of display 300, then the weighting unit 500 will only generate three weighting products for this kind of pixel 320. For example, for the pixel 320 disposed at the $2^{nd}$ row and the $1^{st}$ column, the weighting unit 500 will only generate the weighting products $N_1$, $N_3$ and $N_4$ from the pixel 310 disposed above of the pixel 320, the pixel 310 disposed on the right of the pixel 320 and the pixel 310 disposed beneath of the pixel 320 respectively. Below will further explain how the weighting unit 500 can generate the weighting products $N_1$, $N_2$, $N_3$ and $N_4$.

The rendering unit 472 will divide the gamma value $R_C$ into different rendering values of $R_{D1}$, $R_{D2}$, $R_{D3}$ and $R_{D4}$ according to the gamma value $R_1$, $R_2$, $R_3$ and $R_4$ of the pixels 310 disposed above of, on the left of, on the right of, and beneath of the pixel 320 and the weighting products $N_1$, $N_2$, $N_3$ and $N_4$ aforesaid. Namely, $$R_C=R_{D1}+R_{D2}+R_{D3}+R_{D4} \quad \text{Formula (22):}$$

The rendering values of $R_{D1}$, $R_{D2}$, $R_{D3}$ and $R_{D4}$ will be dispatched to the pixels 310 that are disposed above of, on the left of, on the right of, and beneath of the pixel 320 respectively. Furthermore, the rendering unit 472 will set up the priority orders of the upper, left, right and the lower pixels 310 according to the value of the weighting product $N_1$, $N_2$, $N_3$, and $N_4$. The pixel 310 with a larger weighting product has the higher priority order. For example, if $N_3>N_1>N_4>N_2$, then the priority orders of the four pixels 310 will be the right pixel 310, the upper pixel 310, the lower pixel 310 and then the left pixel 310, from the first to the last. Consequently, the gamma value $R_C$ will be dispatched to the right pixel 310 firstly. In addition, to avoid the excess of the gamma values of the red color subpixels 330R of the upper, left, right and lower pixels 310 after dispatching the gamma value $R_C$, the display 300 will set a threshold value $G_{TH}$ on the rendering unit 472 and keep the gamma value of the red color subpixel of the rendered pixel 310 within the threshold value $G_{TH}$. Furthermore, with the same priority orders of the pixels 320 as the aforesaid example, the rendering value $R_{D3}$ will be equal to the gamma value $R_C$ if the sum of the gamma value $R_3$ and $R_C$ is smaller than or equal to the threshold value $G_{TH}$. However, if the sum of the gamma value $R_3$ and $R_C$ is larger than the threshold value $G_{TH}$, then the rendering value $R_{D3}$ will be equal to the threshold value $G_{TH}$ subtracting the gamma value $R_3$ as below:

$$\begin{cases} R_{D3} = R_C & \text{, if } R_C + R_3 \le G_{TH} \\ R_{D3} = G_{TH} - R_3 & \text{, if } R_C + R_3 > G_{TH} \end{cases} \quad \text{Formula (23)}$$

In addition, after the rendering value $R_{D3}$ is confirmed, if the sum of the gamma value $R_C$ and $R_3$ is larger than the threshold value $G_{TH}$, the rendering unit 472 will calculate the remaining gamma value ($R_C+R_3-G_{TH}$) and dispatch the remaining gamma value ($R_C+R_3-G_{TH}$) to the rest of the upper, the lower, and the left pixels 310 according to the aforesaid priority orders except for the right pixel 310, which has the highest priority order. Namely, when $R_C+R_3>G_{TH}$, the remaining gamma value ($R_C+R_3-G_{TH}$) will be dispatched to the upper pixel 310 at the first place, because the upper pixel 310 has the priority order of the second place. The rendering value $R_{D1}$ of the upper pixel 310 can be described as:

$$\begin{cases} R_{D1} = R_C + R_3 - G_{TH} & \text{, if } R_C + R_3 + R_1 \le 2G_{TH} \\ R_{D1} = G_{TH} - R_1 & \text{, if } R_C + R_3 + R_1 > 2G_{TH} \end{cases} \quad \text{Formula (24)}$$

After the rendering value $R_{D1}$ is confirmed, if the sum of the gamma value $R_C$, $R_3$ and $R_1$ is larger than two times the threshold value $G_{TH}$, the rendering unit 472 will calculate the remaining gamma value ($R_C+R_3+R_1-2G_{TH}$) and dispatch the remaining gamma value ($R_C+R_3+R_1-2G_{TH}$) to the rest of the lower, and the left pixels 310 according to the aforesaid priority orders. Namely, when $R_C+R_3+R_1>2G_{TH}$, the remaining gamma value ($R_C+R_3+R_1-2G_{TH}$) will be dispatched to the lower pixel 310 at the first place, since the lower pixel 310 has the priority order of the third place. The rendering value $R_{D4}$ of the lower pixel 310 can be described as:

$$\begin{cases} R_{D4} = R_C + R_3 + R_1 - 2G_{TH} & \text{, if } \begin{matrix} R_C + R_3 + R_1 + \\ R_4 \le 3G_{TH} \end{matrix} \\ R_{D4} = G_{TH} - R_4 & \text{, if } \begin{matrix} R_C + R_3 + R_1 + \\ R_4 > 3G_{TH} \end{matrix} \end{cases} \quad \text{Formula (25)}$$

After the rendering value $R_{D4}$ is confirmed, if the sum of the gamma value $R_C$, $R_3$, $R_1$ and $R_4$ is larger than three times the threshold value $G_{TH}$, the rendering unit 462 will calculate the remaining gamma value ($B_C+B_3+B_1+B_4-3G_{TH}$) and dispatch the remaining gamma value ($R_C+R_3+R_1+R_4-3G_{TH}$) to the left pixels 310 since the left pixel 310 has the priority order of the fourth place. However, if the sum of the remaining gamma value ($R_C+R_3+R_1+R_4-3G_{TH}$) and the gamma value $R_2$ is larger than the threshold value $G_{TH}$, then the rendering unit 472 will have the rendering value $R_{D2}$ equal to ($G_{TH}-R_2$), that is, the rendering value $R_{D2}$ of the left pixel 310 can be described as:

$$\begin{cases} R_{D2} = \begin{matrix} R_C + R_3 + R_1 + \\ R_4 - 3G_{TH} \end{matrix} & \text{, if } \begin{matrix} R_C + R_3 + R_1 + \\ R_4 + R_2 \le 4G_{TH} \end{matrix} \\ R_{D2} = G_{TH} - R_2 & \text{, if } \begin{matrix} R_C + R_3 + R_1 + \\ R_4 + R_2 > 4G_{TH} \end{matrix} \end{cases} \quad \text{Formula (26)}$$

The previous explanation is based on the example with priority orders of the pixels 310 as the right pixel 310, the upper pixel 310, the lower pixel 310 and then the left pixel 310, from the first to the last. However, even if the priority orders of the pixels 310 are different, the rendering unit 472 will also generate the rendering value $R_{D1}$, $R_{D2}$, $R_{D3}$ and $R_{D4}$ in a similar way. For example, if the priority orders of the pixels 310 are: the upper pixel 310, the left pixel 310, the right pixel 310 and then the lower pixel 310, namely $N_1>N_2>N_3>N_4$, then the rendering values $R_{D1}$, $R_{D2}$, $R_{D3}$ and $R_{D4}$ can be derived according to the following formulas (27)-(30).

$$\begin{cases} R_{D1} = R_C & \text{, if } R_C + R_1 \le G_{TH} \\ R_{D1} = G_{TH} - R_1 & \text{, if } R_C + R_1 > G_{TH} \end{cases} \quad \text{Formula (27)}$$

$$\begin{cases} R_{D2} = R_C + R_1 - G_{TH} & \text{, if } R_C + R_1 + R_2 \le 2G_{TH} \\ R_{D2} = G_{TH} - R_2 & \text{, if } R_C + R_1 + R_2 > 2G_{TH} \end{cases} \quad \text{Formula (28)}$$

$$\begin{cases} R_{D3} = R_C + R_1 + R_2 - 2G_{TH} & \text{, if } R_C + R_1 + R_2 + R_3 \le 3G_{TH} \\ R_{D3} = G_{TH} - R_3 & \text{, if } R_C + R_1 + R_2 + R_3 > 3G_{TH} \end{cases} \quad \text{Formula (29)}$$

$$\begin{cases} R_{D4} = R_C + R_1 + R_2 + R_3 - 3G_{TH} & \text{, if } R_C + R_1 + R_2 + R_3 + R_4 \le 4G_{TH} \\ R_{D4} = G_{TH} - R_4 & \text{, if } R_C + R_1 + R_2 + R_3 + R_4 > 4G_{TH} \end{cases} \quad \text{Formula (30)}$$

Also, for example, if the priority orders of the pixels 310 are: the upper pixel 310, the right pixel 310, the lower pixel 310 and then the left pixel 310, namely $N_1>N_3>N_4>N_2$, then the rendering values $R_{D1}$, $R_{D3}$, $R_{D4}$ and $R_{D2}$ can be derived according to the following formulas (31)-(34).

$$\begin{cases} R_{D1} = R_C & \text{, if } R_C + R_1 \le G_{TH} \\ R_{D1} = G_{TH} - R_1 & \text{, if } R_C + R_1 > G_{TH} \end{cases} \quad \text{Formula (31)}$$

$$\begin{cases} R_{D3} = R_C + R_1 - G_{TH} & \text{, if } R_C + R_1 + R_3 \le 2G_{TH} \\ R_{D3} = G_{TH} - R_3 & \text{, if } R_C + R_1 + R_3 > 2G_{TH} \end{cases} \quad \text{Formula (32)}$$

$$\begin{cases} R_{D4} = R_C + R_1 + R_3 - 2G_{TH} & \text{, if } R_C + R_1 + R_3 + R_4 \le 3G_{TH} \\ R_{D4} = G_{TH} - R_4 & \text{, if } R_C + R_1 + R_3 + R_4 > 3G_{TH} \end{cases} \quad \text{Formula (33)}$$

$$\begin{cases} R_{D2} = R_C + R_1 + R_3 + R_4 - 3G_{TH} & \text{, if } R_C + R_1 + R_3 + R_4 + R_2 \le 4G_{TH} \\ R_{D2} = G_{TH} - R_2 & \text{, if } R_C + R_1 + R_3 + R_4 + R_2 > 4G_{TH} \end{cases} \quad \text{Formula (34)}$$

Furthermore, the adder 474 of the rendering unit 470 will add the gamma value $B_C$ of the pixel 320 to the sum of the blue rendering values $B_{D1}$, $B_{D2}$, $B_{D3}$ and $B_{D4}$ from the neighboring pixels 310, namely $\Sigma B_D$, so that the rendering unit 470 can output the gamma value $B_E$. In other words, the adder 474 will update the gamma value $B_C$ of the blue color subpixel 330B of the pixel 320 according to the rendering value $B_{D1}$, $B_{D2}$, $B_{D3}$ and $B_{D4}$. The updated gamma value $B_C$ of the blue color subpixel 330B of the pixel 320 is the gamma value $B_E$. Afterward, the driver 400 will drive the blue color subpixel 330B and the green color subpixel 330G by the gamma values $B_E$ and $G_B$ respectively.

As mentioned above, in one embodiment of the present invention, the driver 400 starts to calculate the rendering values of the pixels 310 and 320 from the first row and the first column with an order from left to right and top to down, where the rendering values calculated by the driver 400 includes the blue rendering values $B_{D1}$, $B_{D2}$, $B_{D3}$ and $B_{D4}$ of each of the pixel 310 and the red rendering values $R_{D1}$, $R_{D2}$, $R_{D3}$ and $R_{D4}$ of each of the pixel 320. Once the blue rendering values $B_{D1}$, $B_{D2}$, $B_{D3}$ and $B_{D4}$ of any pixel 310 is calculated, the rendering values $B_{D1}$, $B_{D2}$, $B_{D3}$ and $B_{D4}$ will be dispatched to the corresponding pixels 320 to update the gamma value $B_C$ of the blue color subpixel 330B of the pixel 320. Correspondingly, once the red rendering values $R_{D1}$, $R_{D2}$, $R_{D3}$ and $R_{D4}$ of any pixel 320 is calculated, the rendering values $R_{D1}$, $R_{D2}$, $R_{D3}$ and $R_{D4}$ will be dispatched to the corresponding pixels 310 to update the gamma value $R_C$ of the red color subpixel 330R of the pixel 310.

Since the driver 400 calculates the rendering values of the pixels 310 and 320 one by one, the red rendering values $R_{D1}$, $R_{D2}$, $R_{D3}$ and $R_{D4}$ are dispatched to the same pixel 310 at different periods of time. Similarly, the blue rendering values $B_{D1}$, $B_{D2}$, $B_{D3}$ and $B_{D4}$ are dispatched to the same pixel 320 at different periods of time. Take the pixel 310 disposed at the $2^{nd}$ row and the $2^{nd}$ column of the display 300 as an example, the red rendering values $R_{D1}$, $R_{D2}$, $R_{D3}$ and $R_{D4}$ are received with the order of $R_{D4}$, $R_{D3}$, $R_{D2}$ and $R_{D1}$. Take the pixel 320 disposed at the $3^{rd}$ row and the $4^{th}$ column of the display 300 as another example, the blue rendering values $B_{D1}$, $B_{D2}$, $B_{D3}$ and $B_{D4}$ are received with the order of $R_{D4}$, $B_{D3}$, $B_{D2}$ and $B_{D1}$. Therefore, in the same frame period, the gamma value $R_C$ of the red color subpixel of the pixel 310 can be updated by $R_{D4}$, $R_{D3}$, $R_{D2}$ and $R_{D1}$ at several different times, and the gamma value $B_C$ of the blue color subpixel of the pixel 320 can also be updated by $B_{D4}$, $B_{D3}$, $B_{D2}$ and $B_{D1}$ at several different times. The gamma value $B_1$, $B_2$, $B_3$ and $B_4$ as the input to the rendering unit 472 are the gamma values $B_C$ of the blue color subpixels 330B of the four neighboring pixels 320 during the updating process for the gamma values $B_C$ of each of the pixels 320, and the gamma value $R_1$, $R_2$, $R_3$ and $R_4$ as the input to the rendering unit 472 are the gamma values $R_C$ of the red color subpixels 330R of the four neighboring pixels 310 during the updating process for the gamma value $R_C$ of each of the pixels 310.

Figure 5:
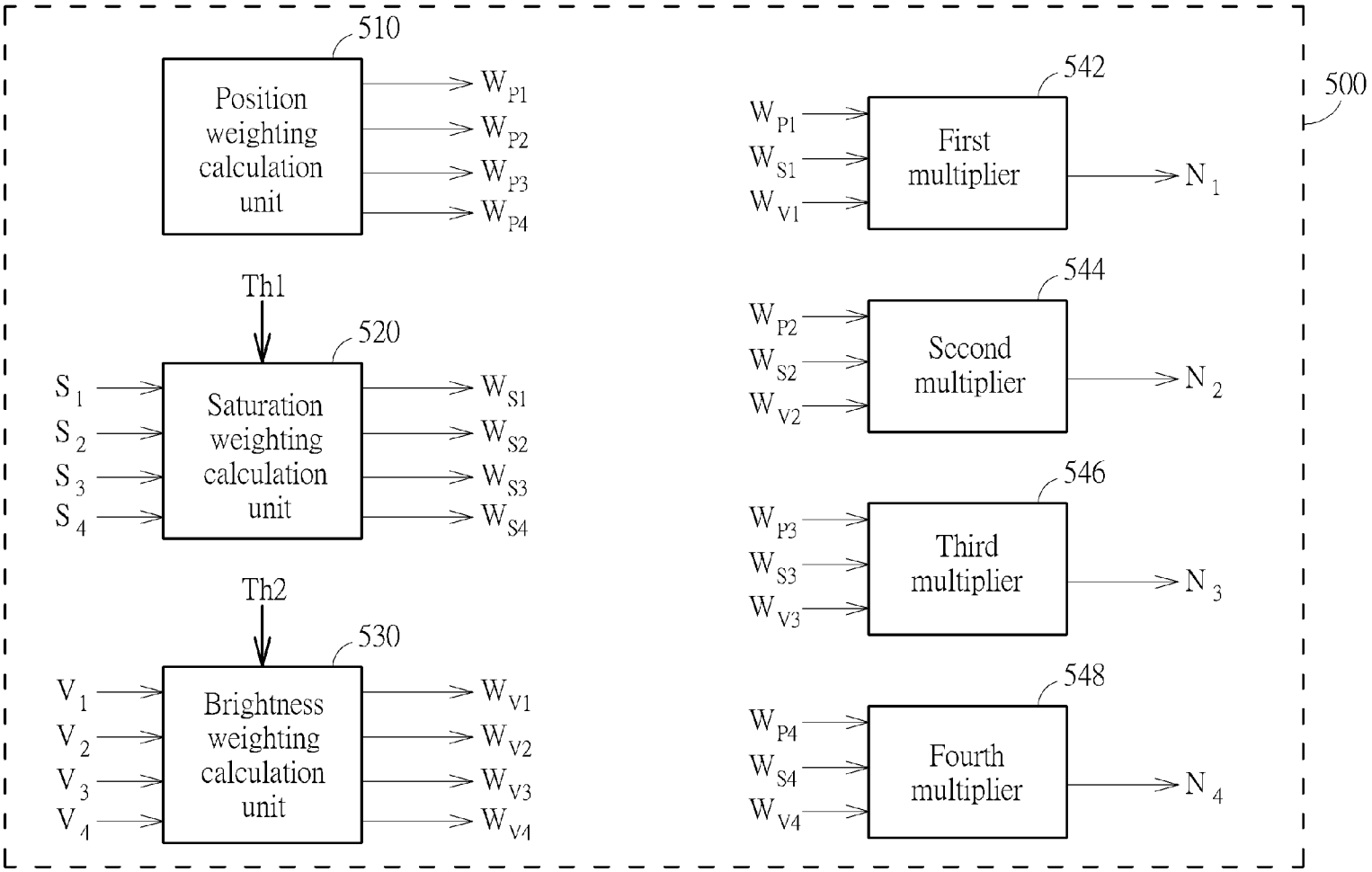
FIG. 5 shows the weighting unit of the driver in FIG. 4.

Please refer to FIG. 5. FIG. 5 shows the weighting unit 500 of the driver 400 in FIG. 4. The weighting unit 500 can be the weighting unit 500 of the rendering module 460 or 470 in FIG. 4. The weighting unit 500 includes a position weighting calculation unit 510, a saturation weighting calculation unit 520, a brightness weighting calculation unit 530, a first multiplier 542, a second multiplier 544, a third multiplier 546 and a fourth multiplier 548.

Since human eyes are more sensitive to green light than red light and blue light, the position weighting calculation unit 510 can set the position weightings $W_{P1}$, $W_{P2}$, $W_{P3}$ and $W_{P4}$ of the four pixels 320 that are adjacent to the pixel 310 according to the distance between the blue color subpixel 330B of each of the four pixels 320 and the green color subpixel 330G of the pixel 310. The position weightings $W_{P1}$, $W_{P2}$, $W_{P3}$ and $W_{P4}$ represent the position weightings of the upper pixel 320, the left pixel 320, the right pixel 320, and the lower pixel 320 respectively. Also, the pixel 320 has its blue color 330B subpixel centered closer to the center of the green color subpixel of the pixel 310 will have a larger position weighting. Take the pixel 310 disposed at the $2^{nd}$ row and the $2^{nd}$ column of the display 300 as an example, the position weightings $W_{P1}$, $W_{P2}$, $W_{P3}$ and $W_{P4}$ of the four neighboring pixels 320 have a relation of $W_{P3}>W_{P1}=W_{P4}>W_{P2}$. In addition, in one embodiment of the present invention, the sum of the position weightings $W_{P1}$, $W_{P2}$, $W_{P3}$ and $W_{P4}$ can be set to 1. However, the present invention is not limited to the aforesaid embodiment. The saturation weighting calculation unit 520 can derive the saturation weightings $W_{S1}$, $W_{S2}$, $W_{S3}$ and $W_{S4}$ of the four neighboring pixels 320 according to saturations $S_1$, $S_2$, $S_3$, and $S_4$ of the four neighboring pixels 320 and a first value Th1. The saturation weightings $W_{S1}$, $W_{S2}$, $W_{S3}$ and $W_{S4}$ represent the saturation weightings of the upper pixel 320, the left pixel 320, the right pixel 320, and the lower pixel 320 respectively. The saturations $S_1$, $S_2$, $S_3$, and $S_4$ can be derived by Formula (4). The first value Th1 is equal to or larger than 1. In one embodiment of the present invention, Th1 can be set to 2. The saturation weighting calculation unit can derive the saturation weightings $W_{S1}$, $W_{S2}$, $W_{S3}$ and $W_{S4}$ of the four neighboring pixels 320 by subtracting the saturations $S_1$, $S_2$, $S_3$, and $S_4$ of the four neighboring pixels 320 from the first value Th1. Namely, the saturation weightings $W_{S1}$, $W_{S2}$, $W_{S3}$ and $W_{S4}$ can be derived as below:

$$W_{S1}=Th1-S_1 \quad \text{Formula (35):}$$

$$W_{S2}=Th1-S_2 \quad \text{Formula (36):}$$

$$W_{S3}=Th1-S_3 \quad \text{Formula (37):}$$

$$W_{S4}=Th1-S_4 \quad \text{Formula (38):}$$

Furthermore, in the rendering module 460, the brightness weighting calculation unit 530 of the weighting unit 500 can derive the brightness weightings $W_{V1}$, $W_{V2}$, $W_{V3}$ and $W_{V4}$ of the four neighboring pixels 320 according to the brightness $V_1$, $V_2$, $V_3$ and $V_4$ of each of the four pixels 320 and a second value Th2. The second value Th2 is larger than 0. The brightness weightings $W_{V1}$, $W_{V2}$, $W_{V3}$ and $W_{V4}$ represent the brightness weightings of the upper pixel 320, the left pixel 320, the right pixel 320, and the lower pixel 320 respectively. The brightness $V_1$, $V_2$, $V_3$ and $V_4$ can be calculated by Formula (5). The brightness weighting calculation unit 530 can derive the brightness weightings $W_{V1}$, $W_{V2}$, $W_{V3}$ and $W_{V4}$ of the four neighboring pixels 320 by calculating the sum of the second value Th2 and the brightness $V_1$, $V_2$, $V_3$ and $V_4$. Namely, the brightness weightings can be derived as below:

$$W_{V1}=V_1+Th2 \quad \text{Formula (39):}$$

$$W_{V2}=V_2+Th2 \quad \text{Formula (40):}$$

$$W_{V3}=V_3+Th2 \quad \text{Formula (41):}$$

$$W_{V4}=V_4+Th2 \quad \text{Formula (42):}$$

The first multiplier 542 will calculate the product of the position weighting $W_{P1}$, the saturation weighting $W_{S1}$ and the brightness weighting $W_{V1}$ to get the weighting product $N_1$ mentioned before. Similarly, the second multiplier 544 will calculate the product of the position weighting $W_{P2}$, the saturation weighting $W_{S2}$ and the brightness weighting $W_{V2}$ to get the weighting product $N_2$, the third multiplier 546 will calculate the product of the position weighting $W_{P3}$, the saturation weighting $W_{S3}$ and the brightness weighting $W_{V3}$ to get the weighting product $N_3$, and the fourth multiplier 548 will calculate the product of the position weighting $W_{P4}$, the saturation weighting $W_{S4}$ and the brightness weighting $W_{V4}$ to get the weighting product $N_4$. That is, the mentioned weighting products can be shown as below:

$$N_1=W_{P1}\times W_{S1}\times W_{V1}=W_{P1}\times(Th1-S_1)\times(V_1+Th2) \quad \text{Formula (43):}$$

$$N_2=W_{P2}\times W_{S2}\times W_{V2}=W_{P2}\times(Th1-S_2)\times(V_2+Th2) \quad \text{Formula (44):}$$

$$N_3=W_{P3}\times W_{S3}\times W_{V3}=W_{P3}\times(Th1-S_3)\times(V_3+Th2) \quad \text{Formula (45):}$$

$$N_4=W_{P4}\times W_{S4}\times W_{V4}=W_{P4}\times(Th1-S_4)\times(V_4+Th2) \quad \text{Formula (46):}$$

In addition, the larger saturation of a pixel 320 implies the purer color the pixel 320 shows. To avoid altering the color shown by a pixel 320 with high saturation S, the saturation weightings $W_{S1}$, $W_{S2}$, $W_{S3}$ and $W_{S4}$ are set to be negative related to the saturations $S_1$, $S_2$, $S_3$, and $S_4$. Furthermore, the brightness V is related to the color contrast of the subpixels of a pixel 320. Therefore, to avoid altering the color contrast between the subpixels of the pixel 320, the brightness weighting $W_{V1}$, $W_{V2}$ $W_{V3}$ and $W_{V4}$ are set to be positive related to the brightness $V_1$, $V_2$, $V_3$, and $V_4$. Furthermore, as mentioned above, the rendering unit 462 will set up the priority orders of the upper pixel 320, the left pixel 320, the right pixel 320 and the lower pixel 320 to dispatch the gamma value $B_C$ according to the weighting products $N_1$, $N_2$, $N_3$, and $N_4$. The pixel 320 with larger weighting product will get the dispatched gamma value $B_C$ with higher priority. Namely, the larger the position weighting, the smaller the saturation and the larger the brightness a neighboring pixel 320 has, the higher priority order the pixel 320 has on receiving the dispatched gamma value $B_C$. In contrast, the smaller the position weighting, the larger the saturation and the smaller the brightness a neighboring pixel 320 has, the lower priority order the pixel 320 has on receiving the dispatched gamma value $B_C$. Thus, the gamma value $B_C$ will be dispatched to a closer, a brighter, or a less saturated pixel 320 with higher priority and the issues of dispatching the gamma value $B_C$ to the pure color zones and the dark zones, which are more sensitive to human eyes, can be avoided. Consequently, the quality of the display 300 can be preserved. Also, if the pixel 320 has the smallest position weighting among the four neighboring pixels 320, the rendering unit 462 can set priority order of the pixel 320 to be the lowest. Therefore, the pixel 320 with its blue color subpixel 330B disposed farthest to the green color subpixel 330G of the pixel 310 will get the dispatched gamma value $B_C$ with least possibility.

The weighting unit 500 of the rendering 470 has the same operations as the weighting unit 500 of the rendering module 460 has. Similarly, since human eyes are more sensitive to the green color, in the rendering module 470, the position weighting calculation unit 510 of the weighting unit 500 can set the position weightings $W_{P1}$, $W_{P2}$, $W_{P3}$ and $W_{P4}$ of the four pixels 310 that are adjacent to the pixel 320 according to the distance between the red color subpixel 330R of each of the four pixels 310 and the green color subpixel 330G of the pixel 320. The position weightings $W_{P1}$, $W_{P2}$, $W_{P3}$ and $W_{P4}$ represent the position weightings of the upper pixel 310, the left pixel 310, the right pixel 310, and the lower pixel 310 respectively. Also, the pixel 310 has its red color 330R subpixel centered closer to the center of the green color subpixel of the pixel 320 will have a larger position weighting. Take the pixel 320 disposed at the $3^{rd}$ row and the $4^{th}$ column of the display 300 as an example, the position weightings $W_{P1}$, $W_{P2}$, $W_{P3}$ and $W_{P4}$ of the four neighboring pixels 310 have a relation of $W_{P3}>W_{P1}=W_{P4}>W_{P2}$. In addition, in one embodiment of the present invention, the sum of the position weightings $W_{P1}$, $W_{P2}$, $W_{P3}$ and $W_{P4}$ can be set to 1. However, the present invention is not limited to the aforesaid embodiment. In the rendering module 470, the saturation weighting calculation unit 520 of the weighting unit 500 can derive the saturation weightings $W_{S1}$, $W_{S2}$, $W_{S3}$ and $W_{S4}$ of the four neighboring pixels 310 according to the saturations $S_1$, $S_2$, $S_3$, and $S_4$ of the four neighboring pixels 310 and the first value Th1. The saturation weightings $W_{S1}$, $W_{S2}$, $W_{S3}$ and $W_{S4}$ represent the saturation weightings of the upper pixel 310, the left pixel 310, the right pixel 310, and the lower pixel 310 respectively. The saturations $S_1$, $S_2$, $S_3$, and $S_4$ can be derived by Formula (4). The first value Th1 is equal to or larger than 1. In one embodiment of the present invention, Th1 can be set to 2. The saturation weighting calculation unit 520 can derive the saturation weightings $W_{S1}$, $W_{S2}$, $W_{S3}$ and $W_{S4}$ of the neighboring pixels 310 by subtracting the saturations $S_1$, $S_2$, $S_3$, and $S_4$ of the four neighboring pixels 310 from the first value Th1. Namely, the saturation weightings $W_{S1}$, $W_{S2}$, $W_{S3}$ and $W_{S4}$ can be derived as below:

$$W_{S1}=Th1-S_1 \quad \text{Formula (47):}$$

$$W_{S2}=Th1-S_2 \quad \text{Formula (48):}$$

$$W_{S3}=Th1-S_3 \quad \text{Formula (49):}$$

$$W_{S4}=Th1-S_4 \quad \text{Formula (50):}$$

Furthermore, in the rendering module 470, the brightness weighting calculation unit 530 of the weighting unit 500 can derive the brightness weightings WV1, WV2, WV3 and WV4 of the four neighboring pixels 310 according to the brightness V1, V2, V3 and V4 of each of the four pixels 310 and a second value Th2. The second value Th2 is larger than 0. The brightness weightings WV1, WV2, WV3 and WV4 represent the brightness weightings of the upper pixel 310, the left pixel 310, the right pixel 310, and the lower pixel 310 respectively. The brightness V1, V2, V3 and V4 can be calculated by Formula (5). The brightness weighting calculation unit 530 can derive the brightness weightings WV1, WV2, WV3 and WV4 of the four neighboring pixels 310 by calculating the sum of the second value Th2 and the brightness V1, V2, V3 and V4. Namely, the brightness weightings can be derived as below:

$$W_{V1}=V_1+Th2 \quad \text{Formula (51):}$$

$$W_{V2}=V_2+Th2 \quad \text{Formula (52):}$$

$$W_{V3}=V_3+Th2 \quad \text{Formula (53):}$$

$$W_{V4}=V_4+Th2 \quad \text{Formula (54):}$$

In the weighting unit 500 of the rendering module 470, the first multiplier 542 will calculate the product of the position weighting WP1, the saturation weighting WS1 and the brightness weighting WV1 to get the weighting product N1 mentioned before. Similarly, the second multiplier 544 will calculate the product of the position weighting WP2, the saturation weighting WS2 and the brightness weighting WV2 to get the weighting product N2, the third multiplier 546 will calculate the product of the position weighting WP3, the saturation weighting WS3 and the brightness weighting WV3 to get the weighting product N3, and the fourth multiplier 548 will calculate the product of the position weighting WP4, the saturation weighting WS4 and the brightness weighting WV4 to get the weighting product N4. That is, the mentioned weighting products can be shown as below:

$$N_1=W_{P1}\times W_{S1}\times W_{V1}=W_{P1}\times(Th1-S_1)\times(V_1+Th2) \quad \text{Formula (55):}$$

$$N_2=W_{P2}\times W_{S2}\times W_{V2}=W_{P2}\times(Th1-S_2)\times(V_2+Th2) \quad \text{Formula (56):}$$

$$N_3=W_{P3}\times W_{S3}\times W_{V3}=W_{P3}\times(Th1-S_3)\times(V_3+Th2) \quad \text{Formula (57):}$$

$$N_4=W_{P4}\times W_{S4}\times W_{V4}=W_{P4}\times(Th1-S_4)\times(V_4+Th2) \quad \text{Formula (58):}$$

In addition, the larger saturation of a pixel 310 implies the purer color the pixel 320 shows. To avoid altering the color shown by a pixel 310 with high saturation S, the saturation weightings WS1, WS2, WS3 and WS4 are set to be negative related to the saturations S1, S2, S3, and S4 by the weighting unit 500 of the rendering module 470. Furthermore, the brightness V is related to the color contrast of the subpixels of a pixel 310. Therefore, to avoid altering the color contrast between the subpixels of the pixel 310, the brightness weighting WV1, WV2, WV3 and WV4 are set to be positive related to the brightness V1, V2, V3, and V4 by the weighting unit 500 of the rendering module 470. Furthermore, as mentioned above, the rendering unit 472 will set up the priority orders of the upper pixel 310, the left pixel 310, the right pixel 310 and the lower pixel 310 to dispatch the gamma value RC according to the weighting products N1, N2, N3, and N4. The pixel 310 with larger weighting product will get the dispatched gamma value RC with higher priority. Namely, the larger the position weighting, the smaller the saturation and the larger the brightness a neighboring pixel 310 has, the higher priority order the pixel 310 has on receiving the dispatched gamma value RC. In contrast, the smaller the position weighting, the larger the saturation and the smaller the brightness a neighboring pixel 310 has, the higher priority order the pixel 310 has on receiving the dispatched gamma value RC. Thus, the gamma value RC will be dispatched to a closer, a brighter, or a less saturated pixel 310 with higher priority and the issues of dispatching the gamma value RC to the pure color zones or the dark zones, which are more sensitive to human eyes, can be avoided. Consequently, the quality of the display 300 can be preserved. Also, if the pixel 310 has the smallest position weighting among the four neighboring pixels 310, the rendering unit 472 can set priority order of the pixel 310 to be the lowest. Therefore, the pixel 310 with its red color subpixel 330R disposed farthest to the green color subpixel 330G of the pixel 320 will get the dispatched gamma value RC with least possibility.

Figure 6:
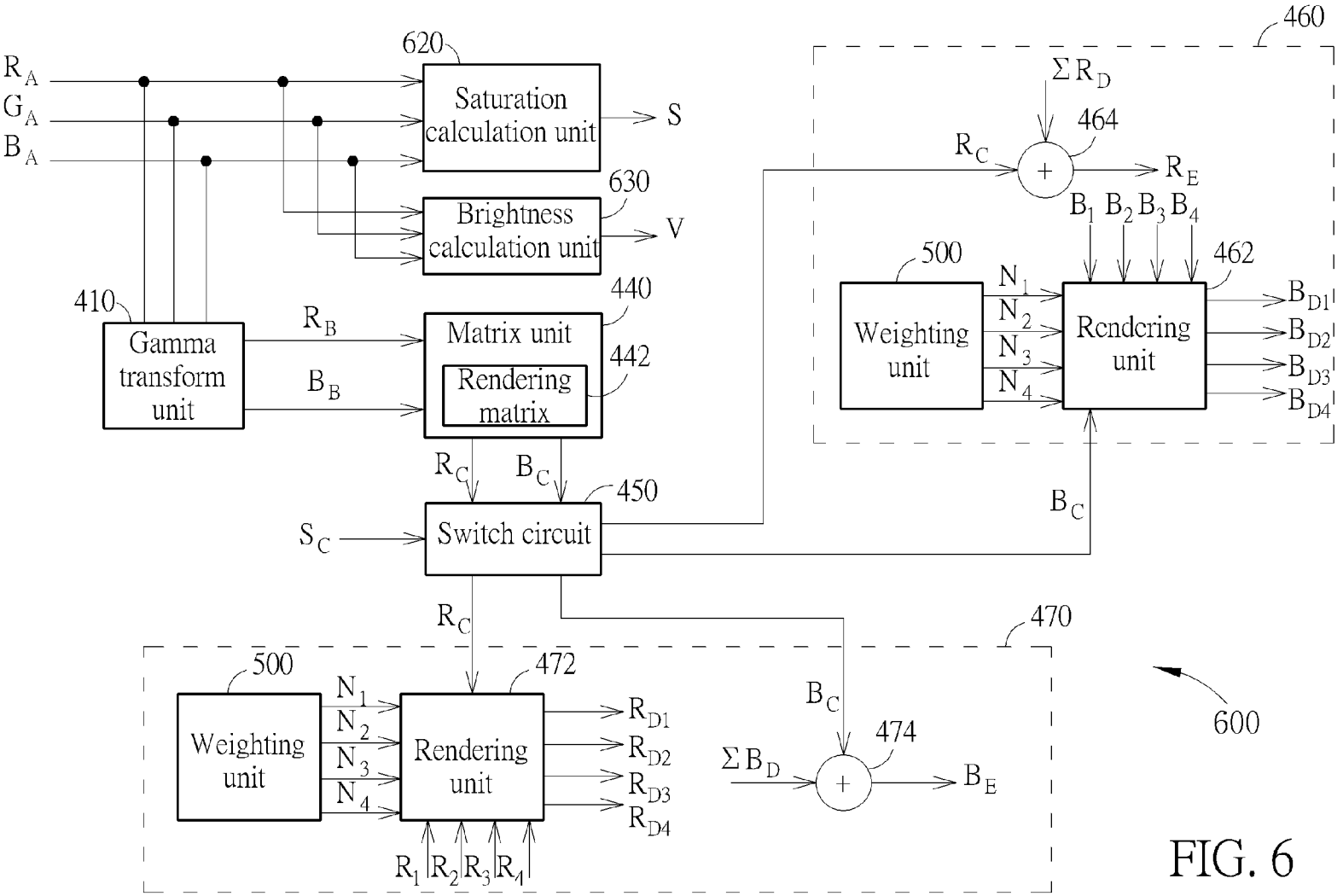
FIG. 6 shows a driver according to another embodiment of the present invention.

Please refer to FIG. 6 and refer to FIGS. 3 and 4 at the same time. FIG. 6 shows the driver 600 according to another embodiment of the present invention. The driver 600 is used to drive the pixels 310 and pixels 320 of display 300. The difference between the driver 600 and the driver 400 is that the saturation calculation unit 420 and the brightness calculation unit 430 of the driver 400 are replaced by the brightness calculation unit 620 and the brightness calculation unit 630 of the driver 600. Where the saturation calculation unit 620 and the brightness calculation unit 630 can derive the saturation S and brightness V mentioned above according to the gray level value RA, GA, and BA directly. Since the gamma transform unit 410, the matrix unit 440, the switch circuit 450, and the rendering modules 460 and 470 of the driver 600 have the same functions as the gamma transform unit 410, the matrix unit 440, the switch circuit 450, and the rendering modules 460 and 470 of the driver 400, duplicated explanation are not required here.

Figure 7:
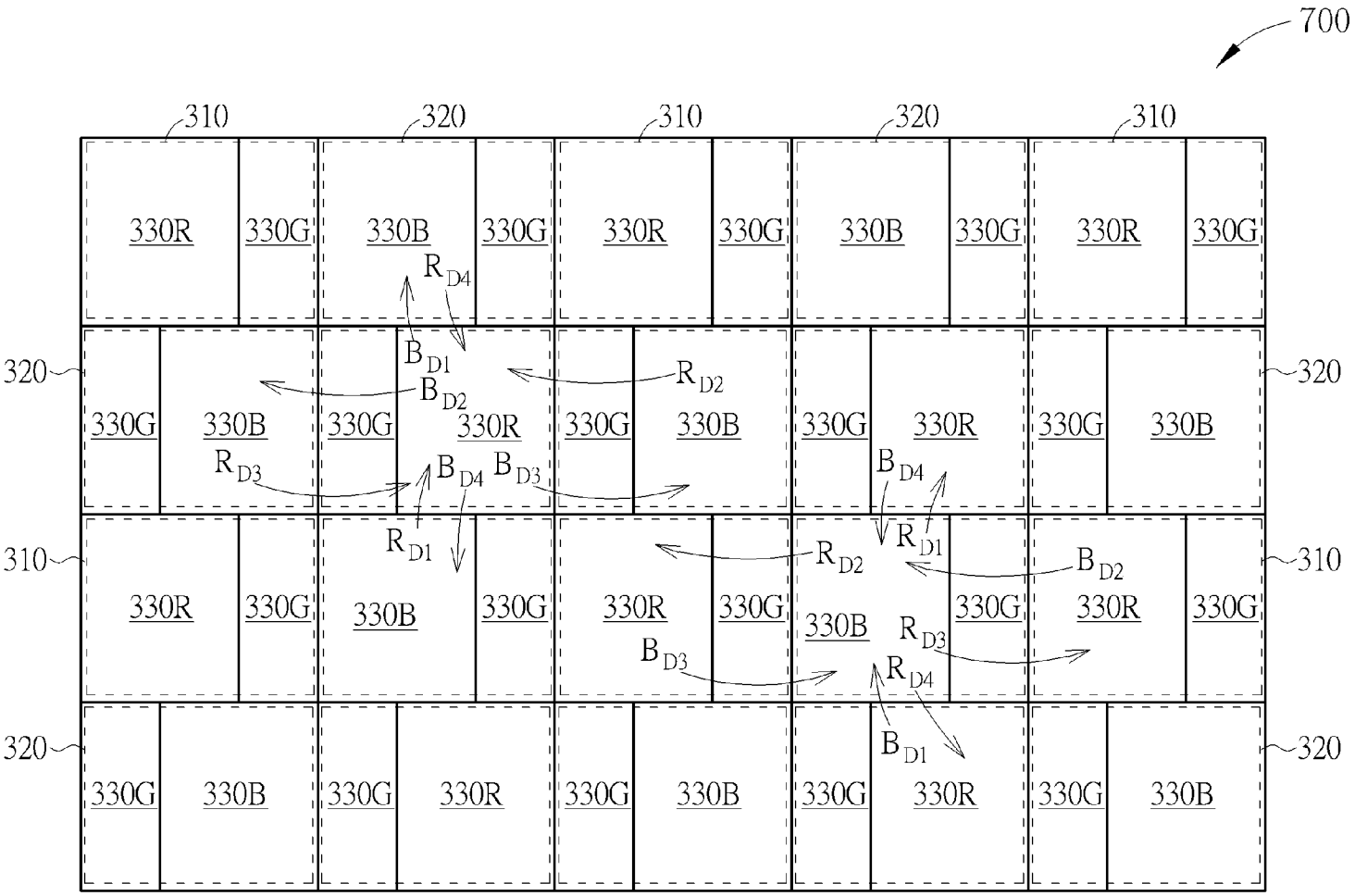
FIG. 7 shows how the SPR display is driven according to another embodiment of the present invention.

Please refer to FIG. 7. FIG. 7 shows a method of driving the display according to one embodiment of the present invention. The display 700 is also an SPR display and comprises of a plurality of pixels 310 and a plurality of pixels 320, where the pixels 310 and the pixels 320 are disposed in an interleaved manner. Each of the pixels 310 comprises a red color subpixel 330R and a green color subpixel 330G. Each of the pixels 320 comprises a blue color subpixel 330B and a green color subpixel 330G. Since the pixel 310 lacks blue color subpixel 330B and pixel 320 lacks the red color subpixel 330R, the display 700 will render color to the subpixels of each of the pixels 310 and 320. Comparing to the display 300 in FIG. 3, the display 700 has differences from the display 300 in that the red color subpixels 330R and the green color subpixels 330G of the pixels 310 in the even number of rows are disposed in an opposite relative position compared to the relative position of the red color subpixels 330R and the green color subpixels 330G of pixels 310 in the odd number of rows. Also, in the display 700, the blue color subpixels 330B and the green color subpixels 330G of pixels 320 in the even number of rows are disposed in an opposite relative position compared to the relative position of the blue color subpixels 330B and the green color subpixels 330G of pixels 320 in the odd number of rows. Other than this difference, the driver 700 has the same driving principles as the driver 300 has. Therefore, the duplicated explanation is not necessary and will be skipped here.

Figure 8:
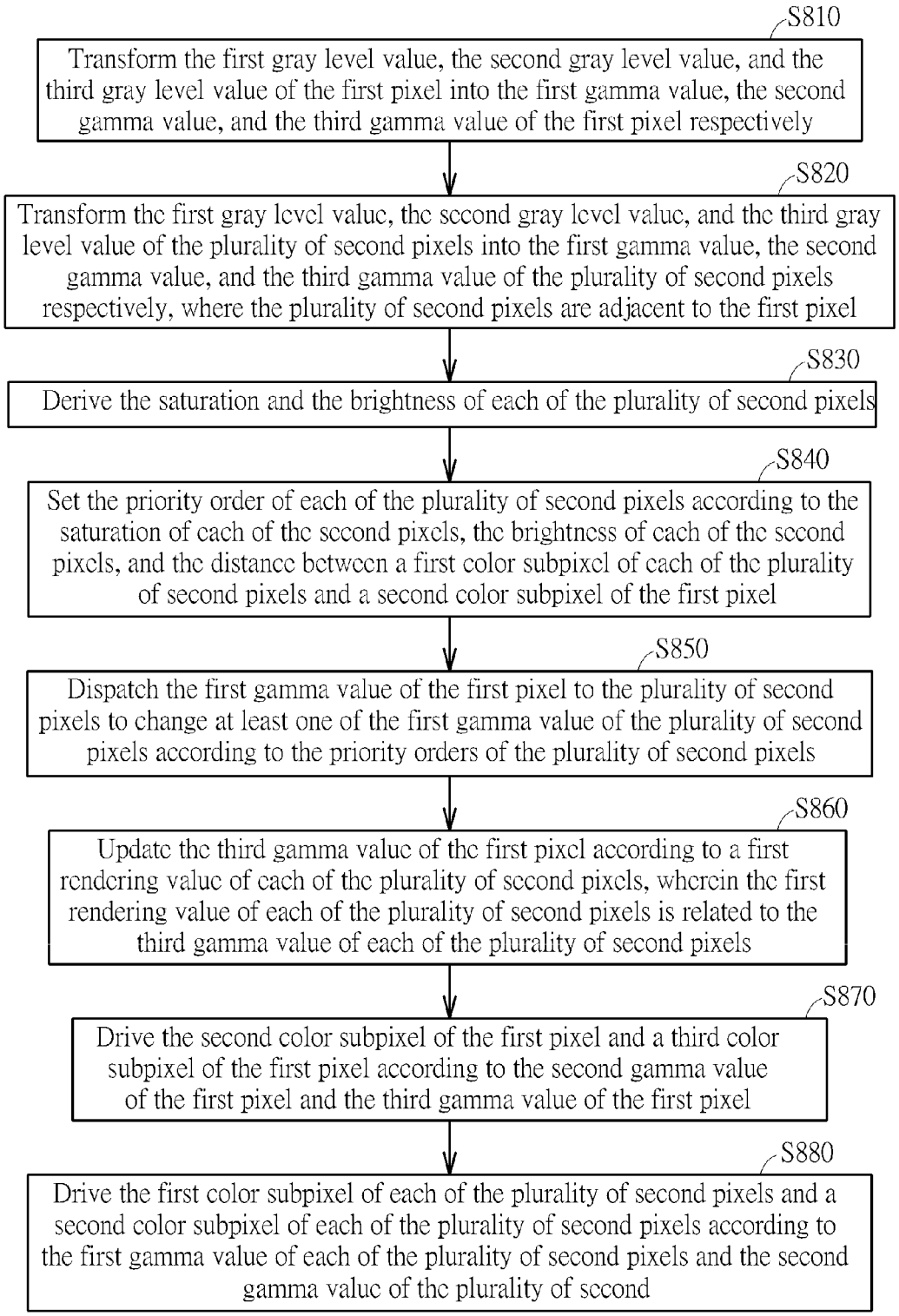
FIG. 8 shows the flow chart of the method of driving display according to one embodiment of the present invention.

Please refer to FIG. 8. FIG. 8 shows the flow chart of a method for driving display according to one embodiment of the present invention. The method for driving display includes steps as below:

Step S810: Transform the first gray level value, the second gray level value, and the third gray level value of the first pixel into the first gamma value, the second gamma value, and the third gamma value of the first pixel respectively.

Step S820: Transform the first gray level value, the second gray level value, and the third gray level value of the plurality of second pixels into the first gamma value, the second gamma value, and the third gamma value of the plurality of second pixels respectively, where the plurality of second pixels are adjacent to the first pixel.

Step S830: Derive the saturation and the brightness of each of the plurality of second pixels.

Step S840: Set the priority order of each of the plurality of second pixels according to the saturation of each of the second pixels, the brightness of each of the second pixels, and the distance between a first color subpixel of each of the plurality of second pixels and a second color subpixel of the first pixel.

Step S850: Dispatch the first gamma value of the first pixel to the plurality of second pixels to change at least one of the first gamma values of the plurality of second pixels according to the priority orders of the plurality of second pixels.

Step S860: Update the third gamma value of the first pixel according to a first rendering value of each of the plurality of second pixels, wherein the first rendering value of each of the plurality of second pixels is related to the third gamma value of each of the plurality of second pixels.

Step S870: Drive the second color subpixel of the first pixel and a third color subpixel of the first pixel according to the second gamma value of the first pixel and the third gamma value of the first pixel.

Step S880: Drive the first color subpixel of each of the plurality of second pixels and a second color subpixel of each of the plurality of second pixels according to the first gamma value of each of the plurality of second pixels and the second gamma value of the plurality of second pixels.

In all the explanation above, the first pixel can be referred to the pixel 320 and the second pixel can be referred to the pixel 310 so the red rendering values RD1, RD2, RD3, and RD4 of the first pixel being dispatched to the neighboring second pixels can also be called the first rendering values of the first pixel, and the blue rendering values BD1, BD2, BD3, and BD4 received by the first pixels can also be called the second rendering values of the first pixel. Similarly, the blue rendering values BD1, BD2, BD3, and BD4 of the second pixel being dispatched to the neighboring first pixels can also be called the first rendering values of the second pixel, and the red rendering values RD1, RD2, RD3, and RD4 received by the second pixels can also be called the second rendering values of the second pixel. Meanwhile, the first pixel can also be referred to the pixel 310 and the second pixel can be referred to the pixel 320 so the blue rendering values BD1, BD2, BD3, and BD4 of the first pixel being dispatched to the neighboring second pixels can also be called the first rendering values of the first pixel, and the red rendering values RD1, RD2, RD3, and RD4 received by the first pixels can also be called the second rendering values of the first pixel. Similarly, the red rendering values RD1, RD2, RD3, and RD4 of the second pixel being dispatched to the neighboring first pixels can also be called the first rendering values of the second pixel, and the blue rendering values BD1, BD2, BD3, and BD4 received by the second pixels can also be called the second rendering values of the second pixel. Also, in the explanation above, the gray level value RA, GA, BA can be referred to the first gray level value, the second gray level value, and the third gray level value, and the gamma value RB, GB, BB can be referred to the first gamma value, the second gamma value, and the third gamma level value.

In summary, by using the method of driving a display according to the embodiments of the present invention, when dispatching the red gamma value from a pixel lacking red color subpixel to the neighboring pixels possessing red color subpixels, the saturation and brightness of the neighboring pixels and the relative positions of the red color subpixels are considered so that the red gamma value will be dispatched to the neighboring pixel that has higher position weighting, higher brightness, and lower saturation firstly. Also, when dispatching the blue gamma value from a pixel lacking blue color subpixel to the neighboring pixels possessing blue color subpixels, the saturation and brightness of the neighboring pixels and the relative positions of the blue color subpixels are considered so that the blue gamma value will be dispatched to the neighboring pixel that has higher position weighting, higher brightness, and lower saturation firstly. Therefore, quality of image displayed on the display could be ensured even when rendering the subpixels due to the increased visibility rate of red color subpixels and the increased visibility rate of blue color subpixels.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for driving a display comprising:

transforming a first gray level value, a second gray level value, and a third gray level value of a first pixel into a first gamma value, a second gamma value, and a third gamma value of the first pixel respectively;

transforming a first gray level value, a second gray level value, and a third gray level value of a plurality of second pixels into a first gamma value, a second gamma value, and a third gamma value of the plurality of second pixels respectively, wherein the plurality of second pixels are adjacent to the first pixel;

deriving saturation and brightness of each of the plurality of second pixels;

deriving a position weighting of each of the plurality of second pixels according to a distance between a first color subpixel of each of the plurality of second pixels and a second color subpixel of the first pixel;

deriving a saturation weighting of each of the plurality of second pixels by calculating the difference between a first value and the saturation of each of the plurality of second pixels, wherein the first value is larger than 1 or equal to 1;

deriving a brightness weighting of each of the plurality of second pixels by adding a second value to the brightness of each of the plurality of second pixels, wherein the second value is larger than 0 or equal to 0;

calculating a weighting product of the position weighting, the saturation weighting and the brightness weighting of each of the plurality of second pixels;

setting a priority order of each of the plurality of second pixels according to the weighting product of each of the plurality of second pixels, wherein a second pixel with larger weighting product has a higher priority order;

dispatching the first gamma value of the first pixel to the plurality of second pixels to change at least one of the first gamma values of the plurality of second pixels according to the priority orders of the plurality of second pixels;

updating the third gamma value of the first pixel according to a first rendering value of each of the plurality of second pixels, wherein the first rendering value of each of the plurality of second pixels is related to the third gamma value of each of the plurality of second pixels;

driving the second color subpixel of the first pixel and a third color subpixel of the first pixel according to the second gamma value of the first pixel and the third gamma value of the first pixel after updating the third gamma value of the first pixel; and driving the first color subpixel of each of the plurality of second pixels and a second color subpixel of each of the plurality of second pixels according to the first gamma value of each of the plurality of second pixels and the second gamma value of the plurality of second pixels after dispatching the first gamma value of the first pixel to the plurality of second pixels.

2. The method for driving a display of claim 1, wherein a sum of the position weightings of the plurality of second pixels is 1, and a second pixel with a larger position weighting has a smaller distance between a first color subpixel center of each of the plurality of second pixels and a second color subpixel center of the first pixel.

3. The method for driving a display of claim 1, wherein the second pixel has the smallest position weighting has the lowest priority order.

4. A method for driving a display comprising:

transforming a first gray level value, a second gray level value, and a third gray level value of a first pixel into a first gamma value, a second gamma value, and a third gamma value of the first pixel respectively;

transforming a first gray level value, a second gray level value, and a third gray level value of a plurality of second pixels into a first gamma value, a second gamma value, and a third gamma value of the plurality of second pixels respectively, wherein the plurality of second pixels are adjacent to the first pixel;

deriving saturation and brightness of each of the plurality of second pixels;

setting a priority order of each of the plurality of second pixels according to the saturation of each of the second pixels, the brightness of each of the second pixels, and a distance between a first color subpixel of each of the plurality of second pixels and a second color subpixel of the first pixel;

calculating a sum of the first gamma value of the first pixel and the first gamma value of the second pixel with highest priority order;

letting the first gamma value of the second pixel with the highest priority order equal a pre-determined threshold value if the sum is larger than the pre-determined threshold value;

deriving a remaining gamma value by subtracting the pre-determined threshold value from the sum;

dispatching the remaining gamma value to the plurality of second pixels except for the second pixel with the highest priority order;

updating the third gamma value of the first pixel according to a first rendering value of each of the plurality of second pixels, wherein the first rendering value of each of the plurality of second pixels is related to the third gamma value of each of the plurality of second pixels;

driving the second color subpixel of the first pixel and a third color subpixel of the first pixel according to the second gamma value of the first pixel and the third gamma value of the first pixel after updating the third gamma value of the first pixel; and driving the first color subpixel of each of the plurality of second pixels and a second color subpixel of each of the plurality of second pixels according to the first gamma value of each of the plurality of second pixels and the second gamma value of the plurality of second pixels after dispatching the first gamma value of the first pixel to the plurality of second pixels.

5. The method for driving a display of claim 4, further comprising:

determining a second rendering value of each of the plurality of second pixels according to the priority order of each of the plurality of second pixels; and adding the second rendering value of each of the plurality of second pixels to the first gamma value of each of the plurality of second pixels to change the first gamma value of each of the plurality of second pixels.

6. The method for driving a display of claim 4, further comprising:

transforming a first gray level value, a second gray level value, and a third gray level value of a third pixel into a first gamma value, a second gamma value, and a third gamma value of the third pixel respectively;

transforming a first gray level value, a second gray level value, and a third gray level value of a plurality of fourth pixels into a first gamma value, a second gamma value, and a third gamma value of the plurality of fourth pixels respectively, wherein the plurality of fourth pixels are adjacent to the third pixel;

deriving saturation and brightness of each of the plurality of fourth pixels;

setting a priority order of each of the plurality of fourth pixels according to the saturation of each of the fourth pixels, the brightness of each of the fourth pixels, and a distance between a third color subpixel of each of the plurality of fourth pixels and a second color subpixel of the third pixel;

dispatching the third gamma value of the third pixel to the plurality of fourth pixels to change the third gamma value of at least one of the plurality of fourth pixels according to the priority orders of the plurality of fourth pixels;

updating the first gamma value of the third pixel according to a first rendering value of each of the plurality of fourth pixels, wherein the first rendering value of each of the plurality of fourth pixels is related to the first gamma value of each of the plurality of fourth pixels;

driving a first color subpixel of the third pixel and the second color subpixel of the third pixel according to the first gamma value of the third pixel and the second gamma value of the third pixel after updating the first gamma value of the third pixel; and driving a second color subpixel of each of the plurality of fourth pixels and the third color subpixel of each of the plurality of fourth pixels according to the second gamma value of each of the plurality of fourth pixels and the third gamma value of the plurality of fourth pixels after dispatching the third gamma value of the third pixel to the plurality of fourth pixels.

7. The method for driving a display of claim 6, wherein the first color subpixel of each of the plurality of second pixels and the first subpixel of the third pixel are red color subpixels; the second color subpixel of the first pixel, the second color subpixel of each of the plurality of second pixels, the second color subpixel of the third pixel, and the second color subpixel of each of the plurality of second pixels are green color subpixels; the third color subpixel of the first pixel and the third color subpixel of each of the plurality of fourth pixels are blue color subpixels.

* * * * *